United States Patent [19]

Kosugi et al.

[11] Patent Number: 5,052,344

[45] Date of Patent: Oct. 1, 1991

[54] INCINERATION CONTROL APPARATUS FOR A FLUIDIZED BED BOILER

[75] Inventors: Shigeru Kosugi; Takahiro Ohshita; Tsutomu Higo, all of Kanagawa; Naoki Inumaru, Tokyo; Hajime Kawaguchi, Kanagawa, all of Japan

[73] Assignee: Ebara Corporation, Tokyo, Japan

[21] Appl. No.: 457,794

[22] PCT Filed: Jul. 13, 1988

[86] PCT No.: PCT/JP88/00693

§ 371 Date: Jan. 3, 1990

§ 102(e) Date: Jan. 3, 1990

[30] Foreign Application Priority Data

Jul. 13, 1987 [JP] Japan ..... 62-174467

[51] Int. Cl.[5] ..... B09B 3/00; F22B 1/00

[52] U.S. Cl. ..... 122/4 D; 110/245; 165/104.16

[58] Field of Search ..... 122/4 D; 165/104.16; 110/245; 422/146

[56] References Cited

U.S. PATENT DOCUMENTS

| | | |
|---|---|---|
| 3,921,590 | 11/1975 | Mitchell et al. . |
| 3,970,011 | 7/1976 | Virr et al. . |
| 4,363,292 | 12/1982 | Engstrom . |
| 4,457,289 | 7/1984 | Korenberg . |
| 4,473,032 | 9/1984 | Maintok ..... 122/4 D |
| 4,528,945 | 7/1985 | Virr et al. . |
| 4,544,020 | 10/1985 | Chrysostome et al. . |
| 4,823,740 | 4/1989 | Ohshita et al. . |

FOREIGN PATENT DOCUMENTS

| | | |
|---|---|---|
| WO83/03294 | 9/1983 | European Pat. Off. . |
| 56-16846 | 4/1981 | Japan . |
| 57-127701 | 8/1982 | Japan . |
| 59-1990 | 1/1984 | Japan . |
| 61-2843 | 1/1986 | Japan . |
| 63-187001 | 8/1988 | Japan . |
| WO89/00659 | 1/1989 | PCT Int'l Appl. . |
| 1475991 | 6/1977 | United Kingdom . |

*Primary Examiner*—Edward G. Favors

*Attorney, Agent, or Firm*—Wenderoth, Lind & Ponack

[57] ABSTRACT

A control circuit (B) is adapted the steam pressure at a boiler drum (17) which receives heat from a incineration chamber (3) in a fluidized bed type boiler (A, C) to be correlated to the thermal energy to be recovered and transferred to the boiler drum and to improve a responsiveness for the suppressed control of increase or decrease of the steam pressure caused by variation of a steam load. The velocity of heat recovery is controlled in accordance with the steam pressure in the boiler drum (17) which is detected by a pressure gauge (20*b*) and a combustibles supply unit (12, 13, 14) for supplying combustibles to the boilers (A, C) is also controlled accordingly.

22 Claims, 15 Drawing Sheets

INCINERATION CONTROL APPARATUS FOR A FLUIDIZED BED BOILER

TECHNICAL FIELD

The present invention relates to a control apparatus capable of controlling the amount of thermal energy recovered from a sector of the fluidized bed of a boiler system and supplied to the boiler drum thereof, the boiler system being so constructed that such combustibles as municipal refuse, industrial waste, coal or the like are incinerated in a so-called fluidized bed and the boiler drum receives the resulting thermal energy. The present invention relates more particularly to the improvement of an incineration control apparatus adapted to enhance the response of the suppressed control of increases and decreases in steam pressure caused by variations in the steam load by correlating the steam pressure in the boiler drum with control of the thermal energy recovered by the boiler drum.

BACKGROUND ART

Fluidized bed boilers are widely known. However, there has been general concern recently about boilers of this type which have a construction wherein the fluidizing medium is divided into two parts, one part being accommodated in the incineration chamber and the other being accommodated in the thermal energy recovery chamber in such a manner that the medium is circulated, thermal energy being recovered from the heat recovery means which takes the form of water pipes or the like provided in the recovery chamber, the amount of recovered thermal energy being controllable.

As for the principle of controlling the amount of thermal energy to be recovered from the fluidizing medium in such a heat recovery chamber, there are known methods wherein the contact area between the heat recovery means such as water pipes or the like and the fluidizing medium in the fluidized bed in the heat recovery chamber is so varied that the amount of thermal energy transferred may be controlled (i.e., the so-called slumping bed method), or wherein the condition of the bed comprised of the fluidizing medium in the heat recovery chamber is so varied that the heat transfer coefficient between the fluidizing medium and the heat recovery means may be controlled. The latter category includes such methods as that wherein the condition of the bed comprised of the fluidizing medium is varied between a fluidized bed condition having an extremely high heat transfer coefficient and a fixed bed condition having an extremely low heat transfer coefficient, heat recovery being intermittently controlled (as disclosed in Japanese Patent Public Disclosure No. 58-183937, U.S. Pat. No. 3,970,011 and U.S. Pat. No. 4,363,292), and that wherein the boundary between the area of the fluidized bed condition and the fixed bed condition is continuously varied so that heat recovery may be controlled continuously and smoothly (as disclosed in Japanese Patent Public Disclosure No. 59-1990). Additionally another method has recently been proposed by the inventor of the present invention (as disclosed in Japanese Patent Application No. 62-9057) in which the fluidizing medium in the heat recovery chamber is supplied with air at a relatively low air velocity (or 0 Gmf–2 Gmf in respect of mass velocity), the fluidizing medium is maintained as a transient bed which is a typical bed condition with a heat transfer coefficient which will vary substantially linearly in relation to the air velocity, the heat transfer coefficient therein being continuously varied in a substantially linear manner so that recovery of thermal energy may be controlled continuously and smoothly.

It should be pointed out here that since controlling the amount of thermal energy recovered by a boiler drum from a heat recovery chamber is particularly effective in maintaining the temperature of the fluidized bed in the incineration chamber within an appropriate range, this type of control is regarded as beneficial because it offers the following advantages.

(1) By keeping the temperature of a fluidized bed at 800° C. to 850° C., incineration efficiency may be improved (in the case of coal burning).

(2) By avoiding any increase in the temperature of the fluidized bed above 850° C., burning of the fluidized bed may be prevented (in the case of incineration of the municipal refuse).

(3) By keeping the temperature of the fluidized bed at 800° C.–850° C., which is a desirable level for dromite, lime stone and the like to absorb sulfur in the case of coal burning, desulfurization may be effectively achieved.

(4) By avoiding any decrease in the temperature of the fluidized bed below 700° C., generation of carbon monoxide may be prevented (in the case of coal burning).

(5) Corrosion of heat recovery means such as water pipes and the like can be prevented.

An example of such an apparatus for controlling the amount of thermal energy recovered from a heat recovery chamber which allows the advantages explained above to be enjoyed is disclosed in U.S. Pat. No. 4,363,292 granted to Engstrom et al. More specifically, according to this apparatus as shown in FIG. 1, the amount of heat recovery from a pipe 106 as a heat recovery means in a second fluidizing zone 100 will be controlled mainly depending on the temperature in a furnace, mainly the temperature of a fluidized bed in a first fluidizing zone 107, with regurating the amount of heat recovery air supplied from second boxes, through orifices 102 to the second fluidizing zone 100 constituting with the fluidizing medium as a heat recovery in a heat recovery chamber, by opening or closing a control valve 104 provide at a conduit 103 in communication with the second box 101 in accordance with a temperature control device TC responsive to the temperature signal from a temperature sensor 105 in the furnaces.

However, with a prior art fluidized bed type boiler of the type explained above, it has been difficult to readily suppress any increase or decrease in the steam pressure in the boiler drum caused by variations in the steam load.

More specifically, with a fluidized bed boiler of this type, it is normal practice to control the amount of combustibles supplied to the fluidized bed in the incineration chamber (or the fluidized bed in the first fluidizing zone 107, for example) by detecting any variation in the steam pressure so as to restrict any influence due to increases in the steam pressure in a boiler drum. This practice is already well known. However, even if the amount of combustibles supplied is increased upon detecting a reduction in the steam pressure, the thermal inertia of the fluidized bed in the incineration chamber is extremely high and hence the temperature of the fluidized bed will not increase abruptly, but only gradually.

Accordingly, if the volume of air supplied for heat recovery to the fluidizing medium in the heat recovery chamber is controlled and the air supply is increased solely in dependence upon the gradual increases in temperature of the fluidized bed which occur in the manner explained above, the amount of thermal energy to be recovered from the fluidizing medium in the heat recovery chamber (or the jet stream bed in the second fluidizing zone, for example) cannot be rapidly augmented. Thus any increase or decrease in the steam pressure in the boiler drum caused by variations in the steam load cannot be quickly restricted, the severity of this phenomenon depending on the amount of recovered heat which is to be circulated back to the boiler drum.

DISCLOSURE OF THE INVENTION

It is therefore a general object of the present invention to solve the problems inherent to the above-mentioned prior arts in which quick responses in the control of variations in steam pressure necessitated by variations in steam load have not been possible.

Another object of the present invention is to provide an incineration control apparatus for a fluidized bed type boiler capable of quickly controlling increases or decreases in the steam pressure in a boiler drum caused by variations in steam load by controlling the amount of thermal energy recovered by the boiler drum in response to any variation in steam pressure which immediately responds to variations in the steam load.

It is a further object of the present invention to provide an incineration control apparatus for a fluidized bed type boiler which exhibits a substantially enhanced response to steam pressure controlling operations at the time of variations in the steam load by an arrangement in which the operation of controlling the amount of combustibles being supplied in accordance with the steam pressure is correlated with the operation of controlling the amount of thermal energy recovered from the heat recovery chamber in accordance with the temperature in the incineration chamber.

It is a still further object of the present invention to provide an incineration control apparatus for a fluidized bed type boiler which will not inhibit response in the operation of controlling increases and decreases in the steam pressure due to external disturbance at the time of a normal increase or decrease in steam load, irrespective of whether the steam load is increasing or decreasing.

Yet another object of the present invention is to provide an incineration control apparatus for a fluidized bed type boiler which will not inhibit response in the operation of controlling decreases in the steam pressure due to external disturbance whether the steam load is increasing without causing a situation wherein insufficient thermal energy is recovered by the boiler drum from the heat recovery chamber even when the normal steam load is excessive.

According to the first embodiment of the present invention, there is provided a means of controlling air supply for heat recovery in accordance with the prevailing steam pressure which is adapted to control the amount of thermal energy recovered by a boiler drum from a heat recovery chamber in accordance with the prevailing steam pressure by varying the amount of air supplied to the heat recovery chamber in accordance with the steam pressure resulting therefrom. More specifically, the arrangement in a typical embodiment is such that the operation of the means for controlling the amount of combustibles supplied which is adapted to control the amount of the combustibles supplied to the incineration chamber in accordance with the steam pressure in the boiler drum is correlated with the operation of the means for controlling air supply for heat recovery which is adapted to control the amount of thermal energy recovered by the boiler drum from the heat recovery chamber by varying the amount of air supplied to the heat recovery chamber in accordance with the temperature in the incineration chamber, and a set temperature value control means is provided which is adapted to control in accordance with the prevailing steam pressure in the boiler drum the set temperature required in a fluidized bed in the incineration chamber on the basis of the control of the air supply for heat recovery. This arrangement provides an incineration control apparatus for a fluidized bed type boiler which is capable of solving the above-mentioned problems and responding immediately to variations in steam pressure so as to instantly change the amount of thermal energy recovered by the boiler drum from the heat recovery chamber, thereby providing quick control of variations in the steam pressure.

According to the present invention as explained above, since a control means adapted to control the amount of thermal energy recovered by the boiler drum from the heat recovery chamber in accordance with the steam temperature is additionally provided, the amount of thermal energy recovered by the boiler drum can be controlled on the basis of variations in steam pressure which will immediately respond to variations in the steam load instead of on the basis of such factors as the temperature in the incineration chamber which may only change gradually due to thermal inertia. This provides the great benefit of allowing increases or decreases in the steam pressure in the boiler drum caused by variations in the steam load to be quickly controlled.

The control means for controlling the amount of thermal energy recovered in accordance with the prevailing steam pressure includes a means for detecting steam pressure adapted to output a steam pressure signal indicating the steam pressure and a temperature detecting means adapted to detect the prevailing temperature in the incineration chamber and output temperature signals indicating the detected temperature. Thus, the amount of combustibles supplied is controlled in response to the temperature signals while the velocity of the air supply for heat recovery will be so controlled that the temperature in the incineration chamber may be kept identical to the specified set temperature. The set temperature control means is adapted to correlate the operational output signals from the pressure controller which serves as the means for controlling the amount of combustibles to be supplied with the set value signals from the temperature controller which serves as the means for controlling the air supply for heat recovery. This allows the operation of controlling the amount of combustibles supplied to the incineration chamber in accordance with the steam pressure in the boiler drum to be correlated with the operation of controlling the amount of air supplied for heat recovery by the boiler drum from the heat recovery chamber by varying the air supply to the heat recovery chamber in accordance with the temperature in the incineration chamber. Thus the amount of air supplied to the heat recovery chamber for heat recovery purposes may be increased or decreased rather rapidly even when the control operation undertaken by the means for controlling the amount of combustibles supplied is relatively long in duration, and this ensures that the response of the operation of controlling the steam pressure at the time of variations in the steam load will be improved to a substantial degree.

According to the second embodiment of the present invention, a means for controlling the amount of combustibles supplied in accordance with the prevailing steam load is provided in addition to the various means employed in the first embodiment, the control means being adapted to operate and generate appropriate operational output signals which serve to continuously adjust the amount of combustibles supplied in correspondence with normal increases and decreases in the steam load which depend on the steam flow rate prevailing during the supply of operational output signals when the pressure controller which controls the amount of combustibles supplied is in a balanced state. Thus the pressure controller which serves as the means for controlling the amount of combustibles supplied is balanced when in the normal condition so that the operational output signal is kept at a value of 50% and the amount of air supplied (air velocity) for heat recovery by the means for controlling supply for heat recovery in response to the operational output signals is held around a median value of 50%. In this way the range of variation in the air supply or the thermal energy capable of being recovered by the boiler drum from the heat recovery chamber may be maximized whether an increase or a decrease in the steam load is taking place, and the response of the operation for controlling increases and decreases in the steam pressure due to external disturbances will not be inhibited at all, irrespective of whether there is an increase or a decrease in the steam load.

According to the third embodiment of the present invention, a means of controlling air supply for incineration is provided in addition to the various means employed in the second embodiment, the means for controlling air supply for incineration being adapted to receive from the means for controlling the amount of combustibles to be supplied in accordance with the steam load operational output signals which increase continuously in correspondence with any increase in steam load and increase the amount of air supplied (or air velocity) for incineration to the incineration chamber. Thus the amount of fluidizing medium circulated in the heat recovery chamber will be increased when the steam load increases normally and a sufficient amount of thermal energy may be safely recovered by increasing the amount of regenerative thermal energy. Hence there will never be a shortfall of thermal energy recovered by the boiler drum from the heat recovery chamber and the response of the operation of controlling decreases in steam pressure due to external disturbances, which involves increasing the steam load, will not be impaired at all. This is a significant improvement over the prior art.

BRIEF EXPLANATION OF DRAWINGS

FIGS. 2A, 2B, 3A, 3B and 4 are explanatory illustrations showing the constitution and operation of the boiler to be controlled by the incineration control apparatus according to the present invention, wherein FIGS. 2A and 2B are vertical sectional views showing the constitution of the boiler; FIG. 3A is a graph showing by way of example the relationship between the air velocity (shown by the abscissa) of the air for incineration and the amount of fluidizing medium circulating (shown by the ordinate); FIG. 3B is a graph showing by way of example the relationship between the air velocity (shown by the abscissa) of the air for heat recovery and the amount of fluidizing medium circulating (shown by the ordinate); and FIG. 4 is a graph showing by way of example the relationship between the air velocity (shown by the abscissa) of the air for heat recovery and the heat transfer coefficient $\alpha$ (shown by the ordinate) of the heat recovery tube in the moving bed;

FIGS. 5A, 5B and 6 show a first embodiment of the incineration control apparatus according to the present invention, wherein FIGS. 5A and 5B are block diagrams respectively showing the constitution of the embodiment; and FIG. 6 is a graph showing by way of example the input and output characteristics of the signal inverter 32 which serves as the means for controlling the set temperature values;

FIGS. 7A, 7B, 8 and 9 show a second embodiment of the incineration control apparatus according to the present invention, wherein FIGS. 7A and 7B are block diagrams respectively showing the constitution of the embodiment; FIG. 8 is a graph illustrating by way of example the input and output characteristics of the computing element 35 which serves as the means for controlling the amount of combustibles supplied in accordance with the steam load; and FIG. 9 is a graph showing by way of example the relationship between the steam flow rate (shown by the ordinate) in the condition wherein the means 31 for controlling the amount of combustibles to be supplied is in a balanced state and the amount of combustibles required for generating that steam flow rate, or the operational output signals YO (shown by the abscissa) from the computing element 35.

BEST MODE OF CARRYING OUT THE INVENTION

Figure 1:
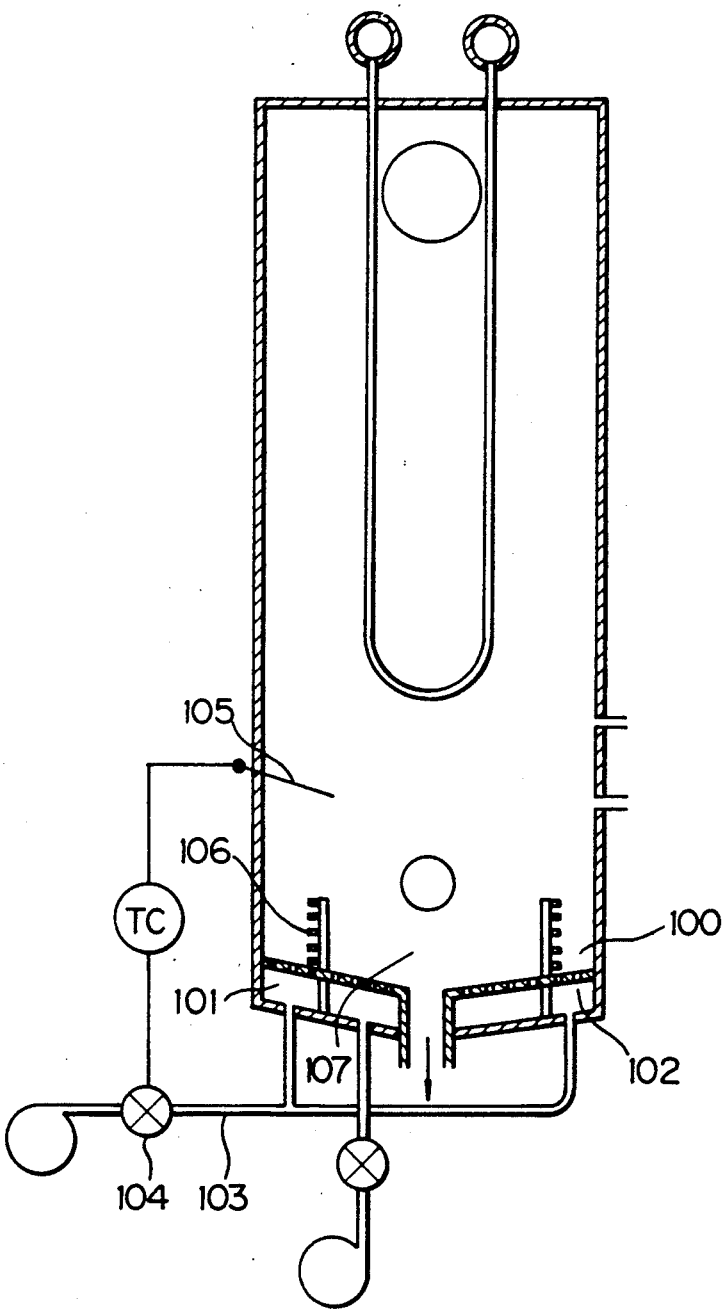
Fig. 1 (PRIOR ART)
FIG. 1 is a schematic view illustrating the construction of a fluidized bed type boiler according to a prior art.
Figure 2A:
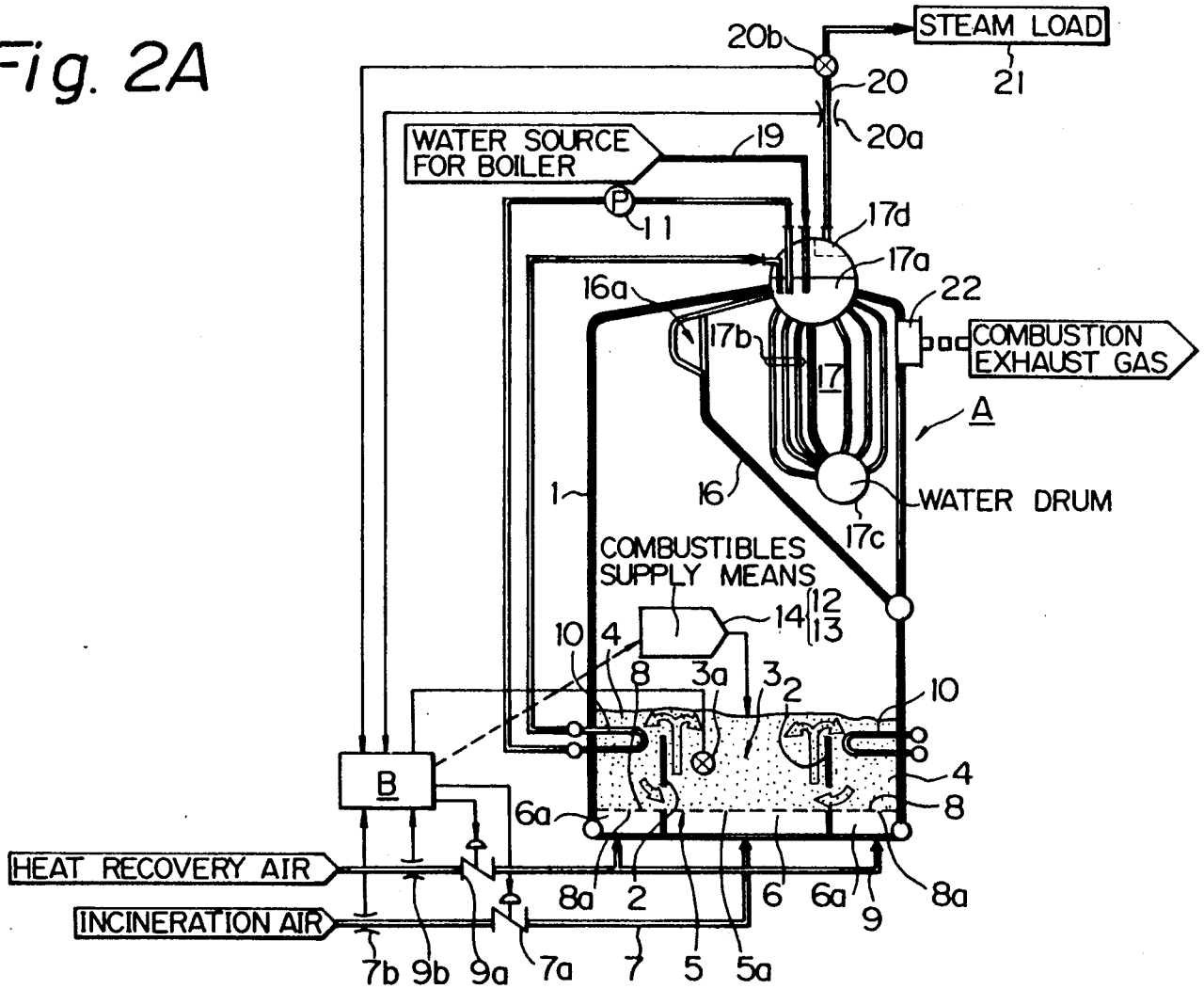
Figure 2B:
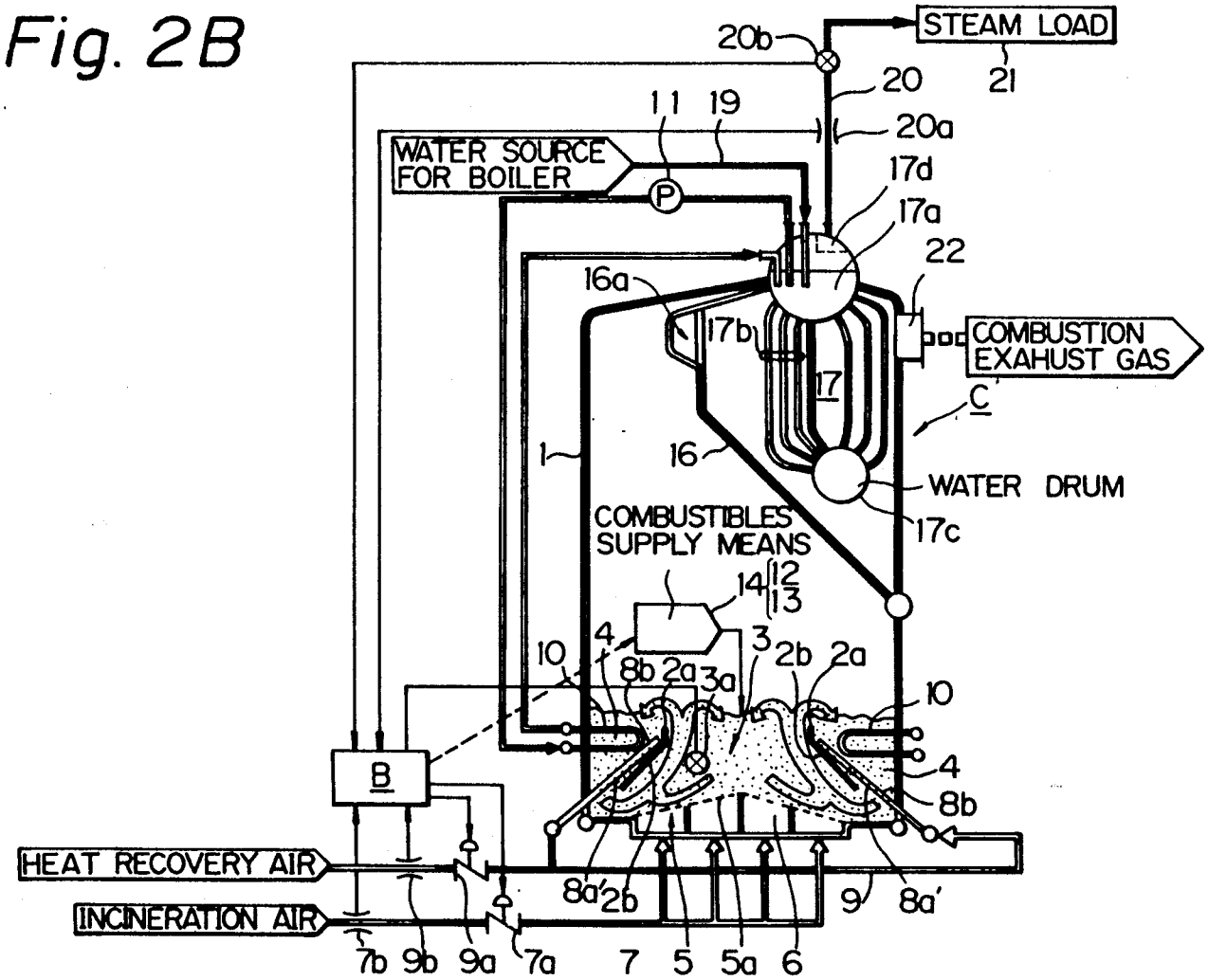

FIGS. 2A and 2B illustrate different examples of boilers which are to be controlled by the incineration control apparatus according to the present invention. In FIG. 2A, the entire boiler A is enclosed by the wall 1 and the incineration chamber 3 is defined by a pair of partition plates 2, 2, while the heat recovery chambers 4, 4 are defined between the partition plates 2, 2 and the wall of the boiler, respectively.

At the bottom portion of the incineration chamber 3 is an air chamber 6 the upper surface of which is covered by an air supply plate 5 having a multiplicity of air supply ports 5*a*. The air chamber 6 may be separated into a plurality of sub-chambers. The air chamber 6 is connected to an incineration air supply tube 7 coming from the incineration air source. A temperature sensor 3*a* which serves as a means for detecting temperature is supported at a position above the air chamber 6. The air supply plate 5, air supply ports 5*a* and air chamber 6 together constitute the means for supplying air for incineration. Inside the incineration air supply tube 7 are inserted a control valve 7*a* and a flow meter 7*b* with the former closer to the source of air for incineration. In the bottom part of the heat recovery chamber 4 is an air chamber 6*a* the upper surface of which is covered by an air dispersion plate 8 (means of air supply for heat recovery) having a multiplicity of air supply ports 8*a* and to which is connected a heat recovery air supply tube 9 from the source of air for heat recovery. In the heat recovery air supply tube are inserted a control valve 9a and a flow meter 9b with the former closer to the source of air for heat recovery. A heat recovery tube 10 is spirally arranged above the air dispersion plate 8 in the heat recovery chamber 4. One end of the heat recovery tube 10 is directly connected to a boiler drum 17, to be explained later, and the other end of the tube 10 is connected to the boiler drum through a circulation pump 11.

The incineration chamber 3 and heat recovery chamber 4 are both filled with particles (having a particle size of approx. 1 mm) of quartz or the like. It is to be noted that the particles contained in the incineration chamber 3 are permitted to flow over the upper end of the respective partition plates 2 into the fluidizing medium contained in the heat recovery chamber 4, while the particles contained in the heat recovery chamber 4 are caused to return to the incineration chamber 3 through the area below the respective partition plates 2, thus allowing circulation of the fluidizing medium.

Disposed at an opening (not shown) that communicates with the incineration chamber 3 is a means 14 for supplying combustibles, which is equipped with a screw type feeder 13 (see FIG. 5A) that is driven by a motor 12 incorporated therein.

On the other hand, the boiler drum 17 is arranged to fit in the wall 1 of the boiler A at the upper portion thereof in such a manner as to be surrounded by a heat receiving water pipe 16 having a flue opening 16a at one portion thereof and capable of receiving heat from the incineration chamber 3. The boiler drum 17 is provided with an upper steam drum 17a and a lower water drum 17c which is connected to the steam drum by means of a multiplicity of convective tubes 17b.

A water supply pipe 19 extends from the water source to the steam drum 17a and the steam pipe 20 extends from the steam drum 17a to a steam load 21 through a steam separator 17d. There are provided in the steam pipe are a flow meter 20a which serves as a means for detecting steam flow rate and a pressure gauge 20b which serves as a means for detecting steam pressure. Reference numeral 22 designates an exhaust port for combustion gas embedded in the wall 1 of the boiler adjacent to the boiler drum 17.

The control apparatus B is provided as a separate unit adjacent to the boiler A which is controlled by the apparatus B. The apparatus B is received over the signal lines the output signals respectively from the temperature sensor 3a, the flow meters 7b, 9b and 20a as well as the pressure gauge 20b. The output signals from the control apparatus B are supplied in turn over the signal lines to the control valves 7a, 9a and a combustibles supplying means 14, respectively.

FIG. 2B illustrates an alternative constitution of a boiler to be controlled by the incineration control apparatus according to the present invention. In FIG. 2B, the entire boiler C is enclosed by the wall 1. The incineration chamber 3 is defined by a pair of reflection partition plates 2b, 2b with the upper end portion 2a bent upwardly and vertically at the central portion of the bottom of the boiler below the inclined surface of the partition plates while the heat recovery chambers 4, 4 are defined at the outer periphery of the central bottom portion above the inclined surface.

At the bottom of the incineration chamber 3 are provided air chambers which are divided into a plurality of sub-chambers the upper surface of which is covered by an air supply plate 5 having a multiplicity of air supply ports 5a and arranged as a ramp leading toward the center of the bottom portion of the incineration chamber. The air chamber 6 is connected to the incineration air tube 7 from the source of air for incineration. The temperature sensor 3a which serves as the means for detecting temperature is supported above the chamber. The air supply plate 5, air supply ports 5a and air chamber 6 together constitute the incineration air supply means. Inside the incineration air tube 7 are inserted in series a control valve 7a and a flow meter 7b with the former closer to the air incineration source. On the other hand, multiple rows of cylindrical air dispersion tubes 8b are provided extending along the inclined upper surface of the reflection partition plate 2b as the heat recovery air supply means (in FIG. 2B, only one row of such tubes are shown). A multiplicity of air dispersion portions 8a' are drilled in the surface of the air dispersion tube 8b on the side facing the reflection partition plate 2b. The lower end of the air dispersion tube 8b is connected to the heat recovery air supply tube 9 which extends from the heat recovery air supply source. A control valve 9a and the flow meter 7b are inserted inside the air supply tube 9 in series with the former closer to the heat recovery air supply source. A heat recovery tube 10 which is incorporated in the heat recovery means is arranged above the air dispersion tube 8b in the heat recovery chamber 4. One end of the heat recovery tube 10 is connected directly to the boiler drum 17 and the other end is connected to the boiler drum via the circulation pump 11.

The incineration chamber 3 and the heat recovery chamber 4 are both filled with a fluidizing medium such as particles of quartz (having a particle size of about 1 mm) or the like. The fluidizing medium in the incineration chamber 3 is allowed to enter the heat recovery chamber 4 over the upper end portion of the respective reflection partition plates 2b while the fluidizing medium in the heat recovery chamber 4 returns to the incineration chamber 3 below the respective reflection partition plates 2b in the heat recovery chamber 4, the fluidizing medium thus being capable of circulating in both chambers.

A means 14 for supplying combustibles are provided at the opening (not shown) provided in communication with the incineration chamber 3. A screw-type feeder 13 (see FIG. 5A) driven by a motor 12 is incorporated in this combustible supply means.

The boiler drum 17 fits in the wall 1 of the boiler C at the upper portion thereof in such a manner as to be surrounded by a heat receiving water pipe 16 having a flue opening 16a at one portion thereof and capable of receiving heat from the incineration chamber 3. The boiler drum 17 is provided with an upper steam drum 17a and a lower water drum 17c which are connected by means of a multiplicity of convective tubes 17b.

A water supply pipe 19 is provided extending from the water source to the steam drum 17a. Provided in a steam pipe 20 extending from the steam drum 17a to a steam load 21 via a steam separator 17d are a flow meter 20a serving as a means for detecting steam flow rate and a pressure gauge 20b serving as a means for detecting steam pressure. Reference numeral 22 designates an exhaust port for combustion gas embedded in the wall 1 of the boiler adjacent to the boiler drum 17.

A control apparatus B is provided as a separate unit adjacent to the boiler C which it controls in accordance with the present invention. The control apparatus B is supplied with output signals which pass through signal lines from the temperature sensor 3*a*, the flow meters 7*b*, 9*b* and 20 and the pressure gauge 20*b*. Output signals from the control apparatus B are supplied through signal lines to the control valves 7*a*, 9*a* and the combustion supply means 14.

A general explanation of the operation of the boilers A and C shown in FIGS. 2A and 2B and controlled by the incineration control apparatus according to the present invention will now be given.

The fluidizing medium in the incineration chamber 3 is blown upwardly by incineration air having an adequate air velocity (a mass velocity of more than about 2 Gmf) which is supplied into the air chamber 6 through the incineration air pipe 7 and injected upwardly in the incineration chamber 3 from the air supply ports 5*a* of the air supply plate 5, thus forming a fluidized layer to become a fluid bed.

A part of the fluid bed in the incineration chamber 3 is caused to flow from the splashing surface of the fluid bed and a portion of the fluidizing medium which jumps over the upper end portion 2*a* of the partition plate 2 is caused to swirl into the heat recovery chamber 4. The same quantity of fluidizing medium, i.e. corresponding to the amount of fluidizing medium thus entering the heat recovery chamber 4, is caused to return to the incineration chamber 3, thereby creating a circulating flow. The quantity of fluidizing medium which may flow into the heat recovery chamber 4 from the incineration chamber 3 can be controlled in accordance with the air velocity of the incineration air (or the mass velocity).

Figure 3A:
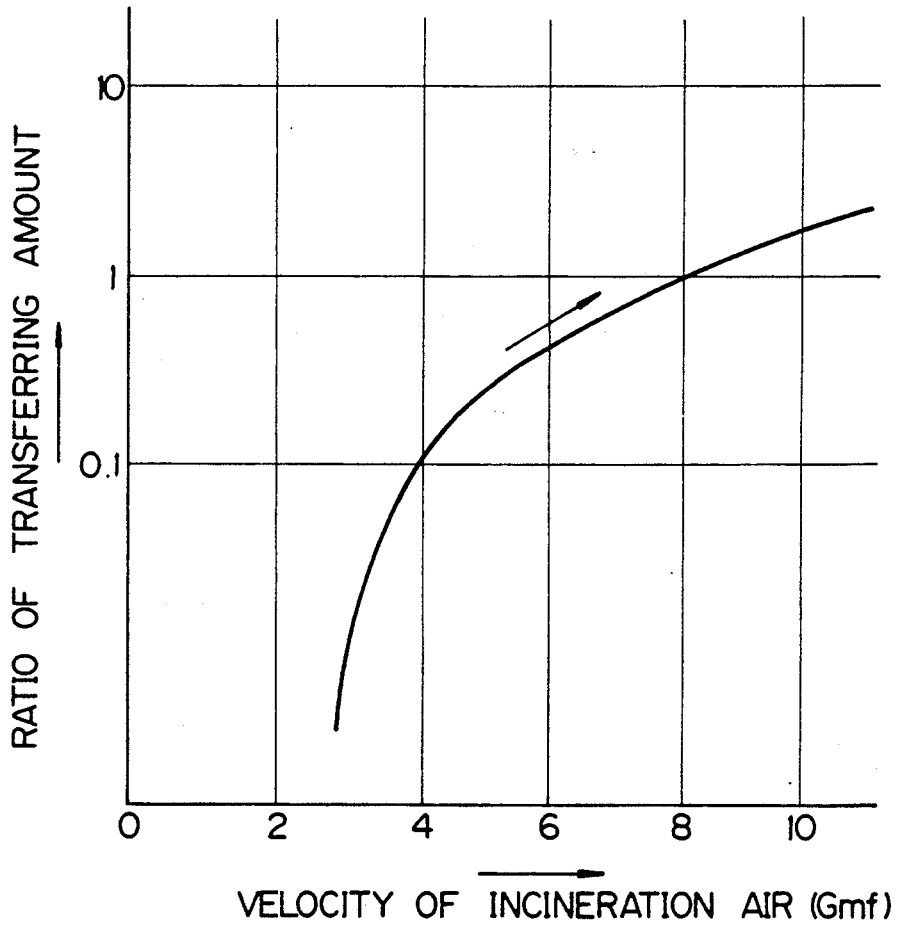

FIG. 3A illustrates an example of the relationship between the air velocity of the incineration air (the mass velocity) and the amount of fluidizing medium which flows into the heat recovery chamber from the incineration chamber. According to this graph shown in FIG. 3A, when the air velocity varies in the range of from 4 Gmf to 8 Gmf, the amount of circulating fluidizing medium may be controlled to not exceed a value of ten times in the approximate range of from 0.1 to 1.

Figure 3B:
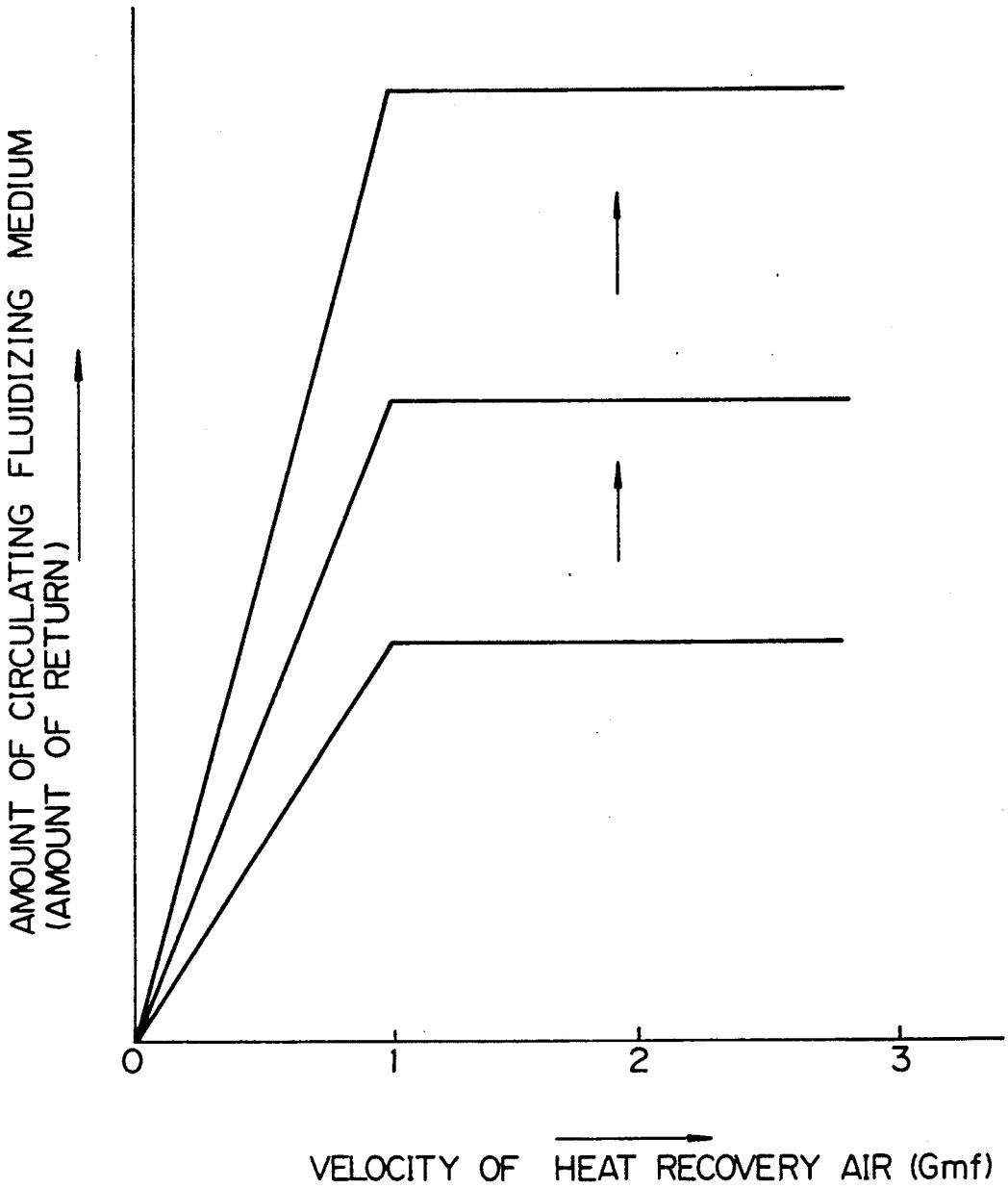

FIG. 3B illustrates an example of the relationship between the air velocity of the heat recovery air (or the mass velocity) and the descending speed of the fluidizing medium in the moving bed in the heat recovery chamber 4, or the amount of fluidizing medium which may be returned to the incineration chamber 3 from the heat recovery chamber 4. According to this relationship, the amount of circulating fluidizing medium which is determined from the amount of fluidizing medium to be returned to the incineration chamber may be expressed by the relationship (or operational curve) with the amount of fluidizing medium which flows into the heat recovery chamber (or the parameter shown in FIG. 3B). The extent of circulation varies depending on the combustion air velocity and increases linearly for each amount of fluidizing medium that overflows from the incineration chamber to the heat recovery chamber. If the amount for the circulation of fluidizing medium flowing from the incineration chamber is specified, this amount of fluidizing medium may increase or decrease substantially proportionally to the air velocity for heat recovery expressed by the abscissa along the corresponding operational curve in the range of 0 to 1 Gmf of the air velocity for incineration.

Accordingly when the air velocity of the incineration air is constant, the amount of circulating fluidizing medium may be controlled in accordance with the air velocity of the air for heat recovery. When the air velocity of the incineration air is not constant, however, the amount of circulating fluidizing medium may be controlled in accordance with the air velocity of both the air for heat recovery and the air for incineration.

Combustibles such as coal or the like, or waste such as municipal refuse or the like are charged onto the fluid bed in the incineration chamber 3 for incineration there and keep the fluid bed at a high temperature in the order of 800° C.–900° C. As a result, the boiler drum 17 receives the heat generated by this high temperature and converts the water supplied to the boiler drum 17 via the water supply pipe 19 into steam in the steam drum 17*a*. Then, after water has been removed by the steam water separator 17*d*, the steam will be supplied to the steam load 21 via the steam pipe 20. The operation of boiler of the type explained above is well known in itself.

Figure 4:
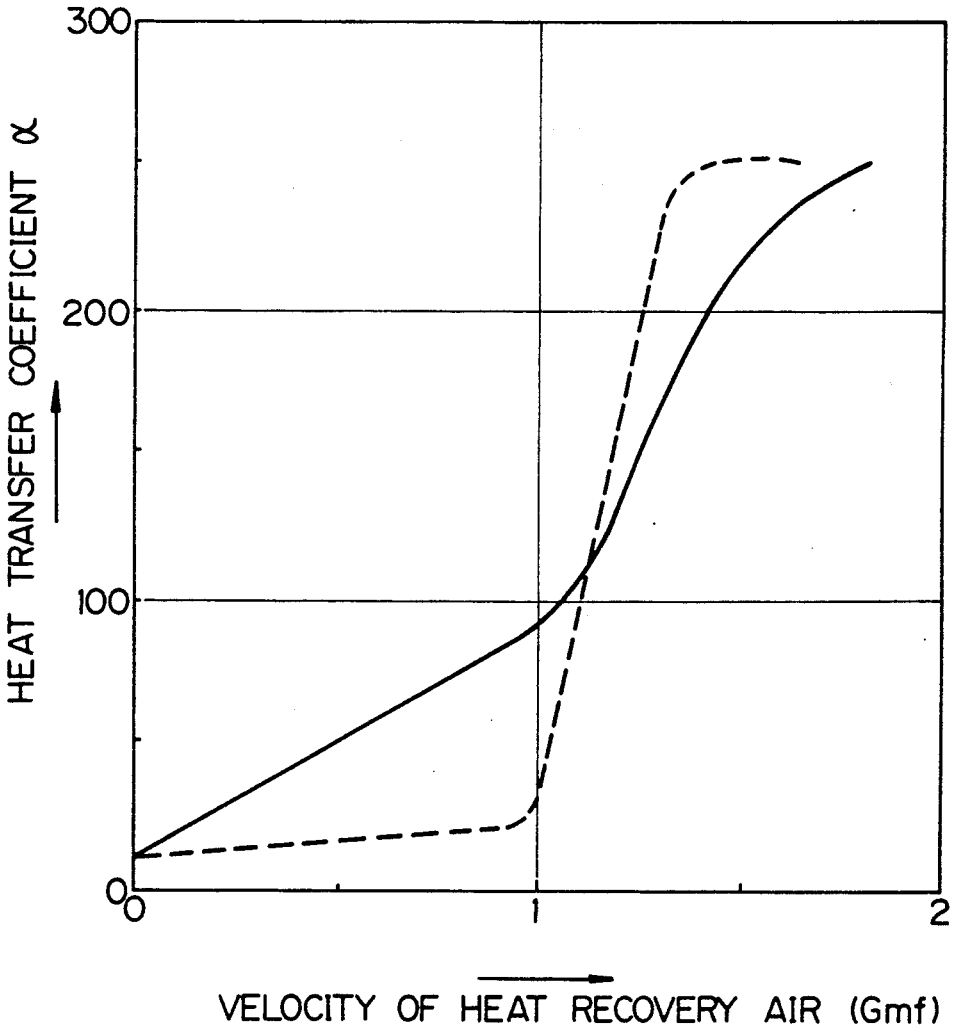

On the other hand, the fluidizing medium in the heat recovery chamber 4 will form a moving bed which gradually descends in an orderly fashion in the downward direction as a solid substance in response to injection of the air for heat recovery, the air velocity of which is relatively slow from the dispersion ports 8*a* of the air dispersion plate 8 in the heat recovery chamber. This moving bed will remain in contact with the heat recovery tube 10 such as to direct the heat in the moving bed into the water in the heat recovery tube 10 by means of heat transfer. Consequently, the heated water in the heat recovery tube 10 will be forced into the steam drum 17*a* by means of the circulation pump 11. In this way, the heat in the fluidizing medium in the heat recovery chamber 4 or the heat in the fluid bed in the incineration chamber 3 will be recovered by and transferred to the boiler drum 17. In this way, the heat in the fluidizing medium contained in the heat recovery chamber 4 and the heat in the fluid bed in the incineration chamber 3 will be transferred to the boiler drum. However, it is to be noted that the amount of thermal energy recovered may be controlled in accordance with the air velocity (or the mass velocity) of the air for heat recovery which is into the heat recovery chamber 4 through the air dispersion plate 8. More specifically, FIG. 4 illustrates in solid lines an example of the relationship between the velocity (or the mass velocity) of the heat recovery air and the heat transfer coefficient $\alpha$ of the heat recovery tube 10 in the moving bed. According to this graph, when the air velocity of the heat recovery air is varied in the range from 0 Gmf to 2 Gmf, the heat transfer coefficient $\alpha$ may be controlled substantially linearly with a relatively large gradient (or gain) compared to that of the fluidized bed or the fixed bed.

In the same graph, the dotted line indicates examples of the heat transfer coefficient which will vary depending on the air velocity, the indicated heat transfer coefficients being those which would normally be attained in a fixed bed at an air velocity of less than 1 Gmf and in a fluidized bed at an air velocity of more than 2 Gmf, respectively, these being shown in comparison with those attained in a moving bed (indicated by the solid line). As this graph shows, the variation in the heat transfer coefficients resulting from changes in the air velocity is slight (or the gradient is extremely gentle), and although any variation in the heat transfer coefficient in accordance with air velocity will become quite considerable in the transitional area between the fixed bed and the fluidized bed, the range of air velocity corresponding to this transitional area is so small that control of the heat transfer coefficient at the fixed bed, fluidized bed or the transitional area is not of any practical significance.

Since operation of the boiler C shown in FIG. 2B is identical to that of the boiler A which has already been explained, an explanation of it will not be given here.

The concrete constitution and operation of an incineration control apparatus B according to the present invention will now be explained. It is to be noted that the same reference numerals and reference symbols are used in the following explanation to designate components which are the same as those already referred to in the description of.

Figure 5A:
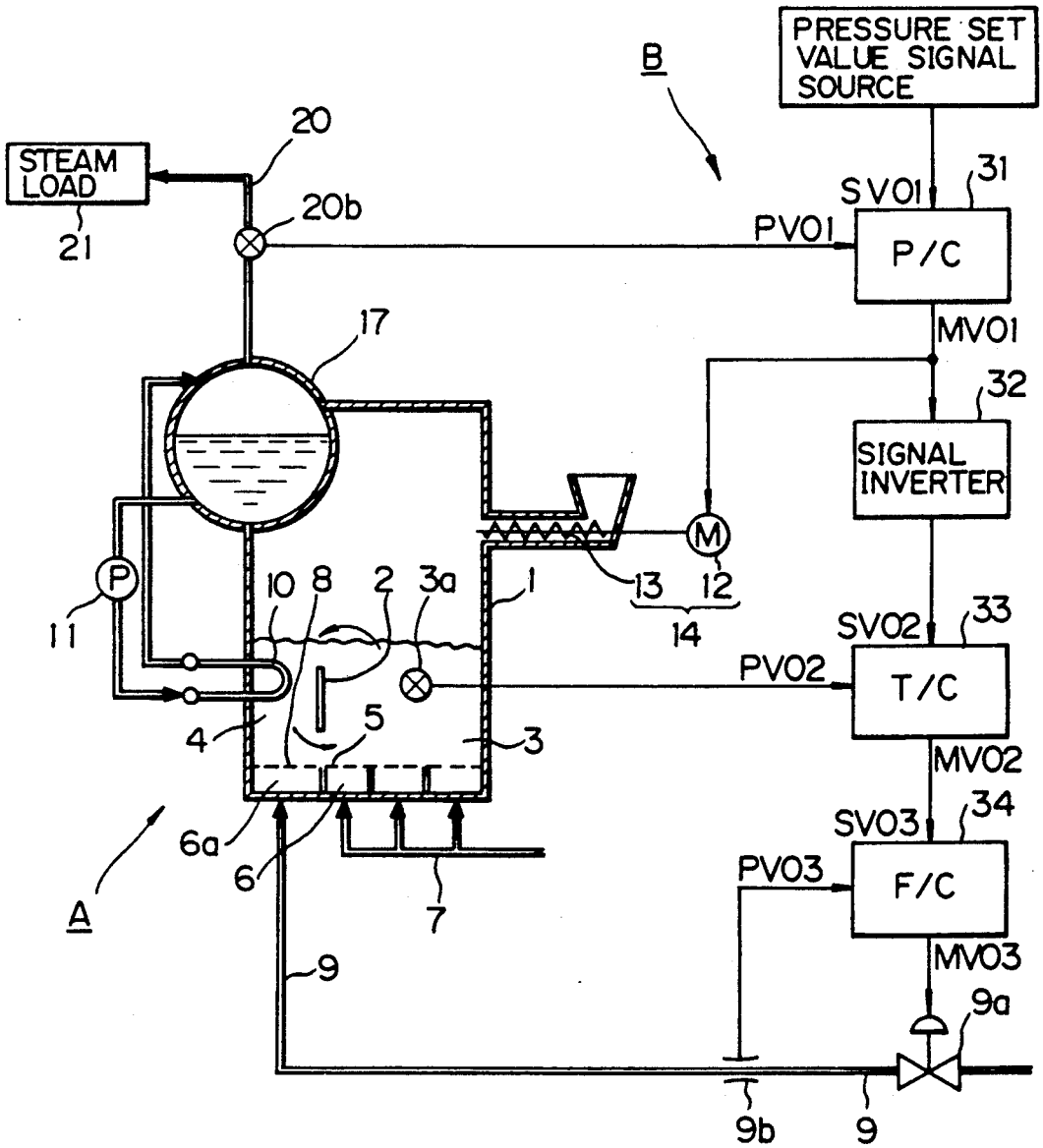
Figure 5B:
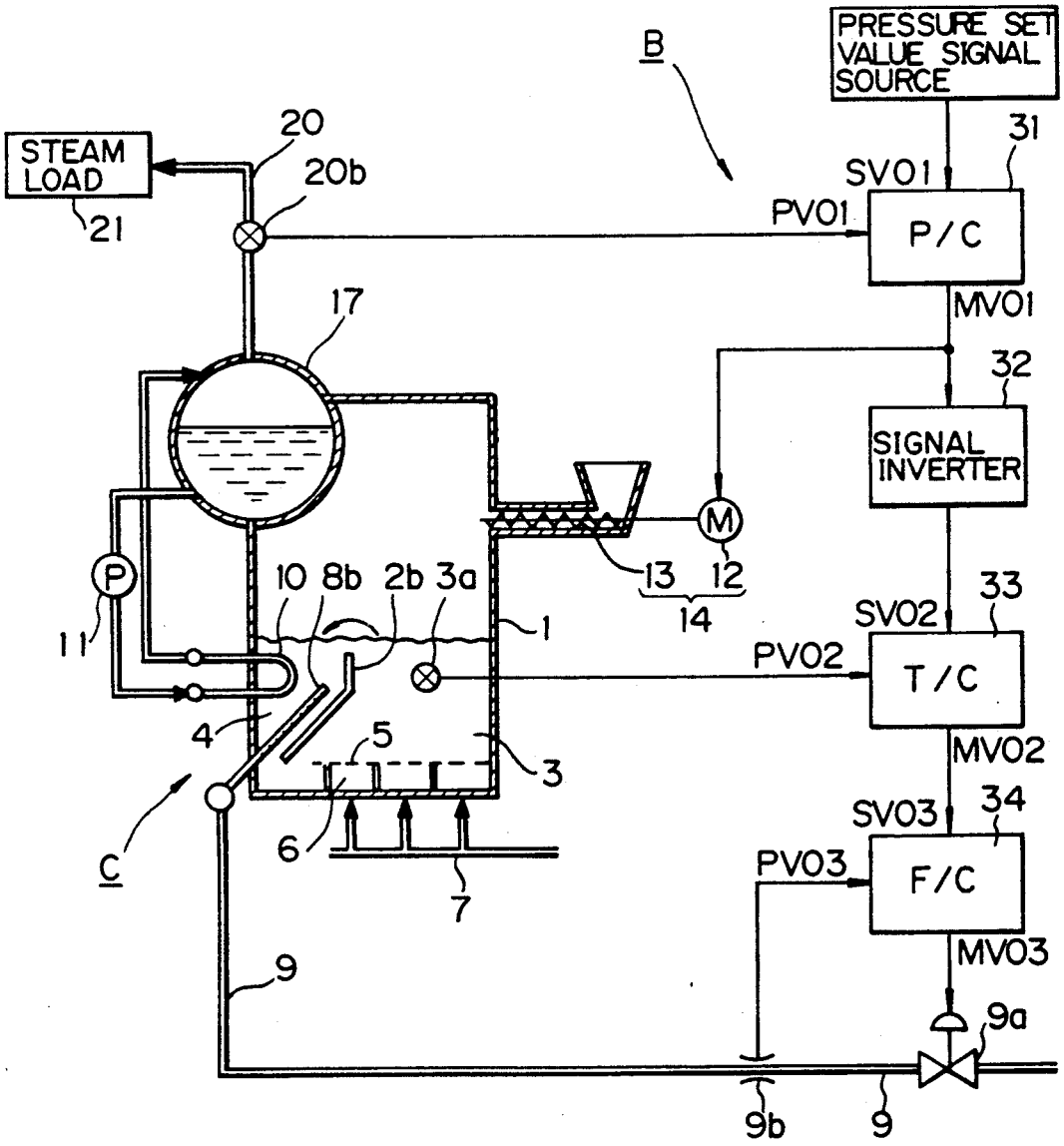

FIGS. 5A and 5B illustrate the first embodiment of the incineration control apparatus according to the present invention as applied to the boilers A and C. The output terminal of the pressure gauge 20*b* contained in the steam pipe 20 is connected to a terminal for inputting input signal PV01 to the pressure controller 31 which serves as means for controlling the amount of combustibles supplied and a terminal for inputting the set pressure value SV01 to the pressure controller 31 is in turn connected to the source of relevant set pressure value signals. The terminal for the operational output signal MV01 from the pressure controller 31 is connected to the input terminal of a signal inverter 32 which serves as a means for controlling the set temperature value as well as to a motor 12 incorporated in the combustion supply means 14 at an intermediate position toward the branch to the signal inverter.

The output of the signal inverter 32 is connected to the terminal for the set temperature value input signal SV02 to a temperature controller 33, and the temperature sensor 3*a* that serves as a means for detecting the temperature in the incineration chamber 3 is connected to the terminal for inputting the input signal SV02 to the temperature controller 33. The terminal for the operational output signal MV02 from the temperature controller 33 is connected to the terminal for inputting the set flow rate value input signal SV03 to a flow rate controller 34.

The terminal for the operational output signal MV03 from the flow rate controller 34 is connected to the control terminal of the control valve 9*a* contained in the heat recovery air pipe 9 and the terminal for inputting the input signal PV03 to the flow rate controller 34 is connected to the output terminal of the flow meter 9*b* contained in the air pipe 9. The temperature controller 33, flow controller 34, control valve 9*a* and flow meter 9*b* contained in the air pipe 9 together constitute a means for controlling the air supply for heat recovery. In addition, they also constitute, together with the combustibles supply control means 31 and the set temperature value control means 32, means for controlling air supply for heat recovery in accordance with steam pressure.

Operation of the incineration control apparatus shown in FIGS. 5A and 5B will next be explained. As the steam load increases, the steam pressure detected by the pressure gauge 20*b* in the steam pipe 20 will be reduced, and the signal PV01 input to the pressure controller 31 will thus be reduced too. Then, since the input signal PV01 will become smaller relative to the pressure set value signal SV01 which is set at a constant value, the operational output signal MV01 from the pressure controller 31 shows a tendency to rise, thereby increasing the rotational speed of the motor 12 in the combustion supply means 14. In this way, the operational speed of a screw type feeder 13 will be increased in order to increase the amount of combustibles supplied, whereby incineration in the incineration chamber can be made more active. Thus, the temperature of the fluidized bed in the incineration chamber 3 will be raised in the long run and, as a result, the amount of heat received by the boiler drum from the incineration chamber 3 will also increase, so that the steam pressure in the boiler drum 17 will gradually increase and return to its previous level.

Figure 6:
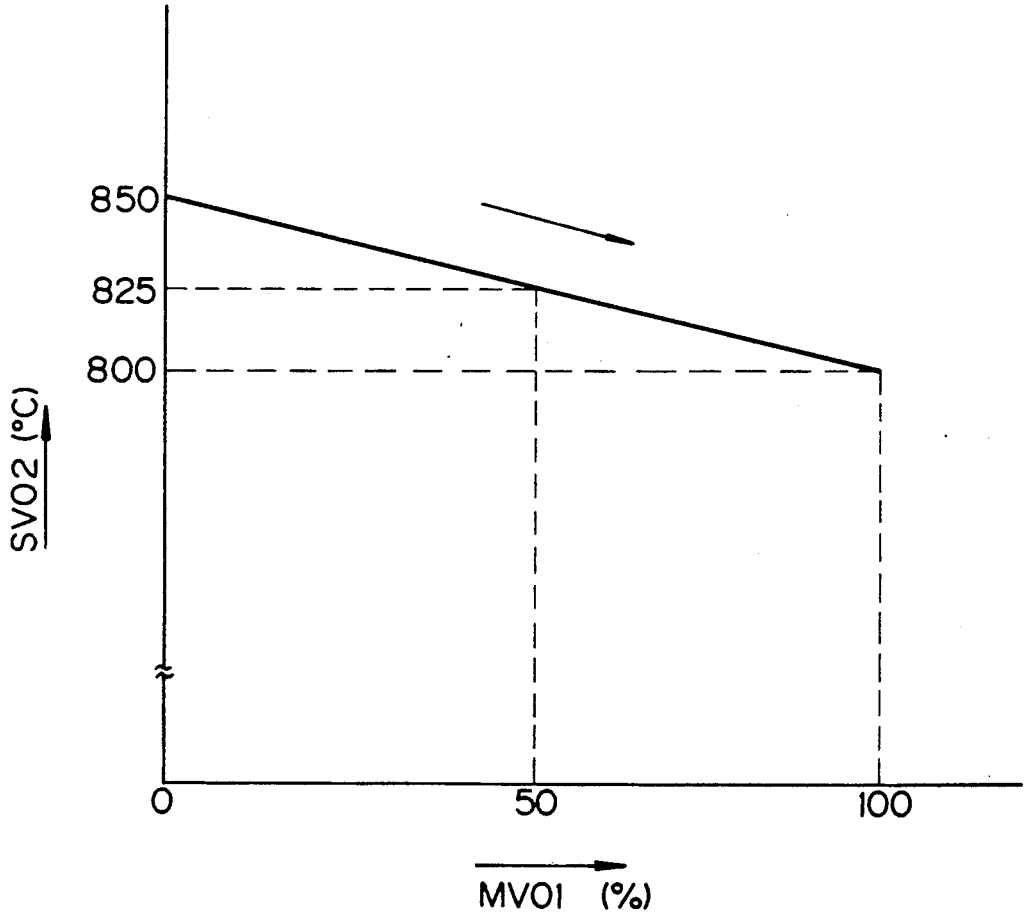

While the above-mentioned operation is taking place, in the short term the signal inverter 32 will respond to the operational output signal MV01 from the pressure controller 31 and supply the output signals thereof to the temperature controller 33 as the set temperature value signal SV02 for the temperature controller, thereby enabling changes in the set temperature value. More specifically, the signal inverter 32 has input/output characteristics such as those shown in FIG. 6, so it will receive as an input signal the operational output signal MV01 from the pressure controller 31 which varies in the range of from 0% to 100%, and will output the temperature set value signal SV02 corresponding to a temperature in the range of from 800° C. to 850° C. to the temperature controller 33. Since the operational output signal MV01 has a tendency to increase in the example of operation explained, the point at which the signal inverter will be activated will shift in the direction indicated by the arrow in FIG. 6, and the set temperature value signal SV02 supplied to the temperature controller will thus change to a lower value. It should be understood here that the variation range of the set temperature value signal SV02 corresponding to the variation range of 0% to 100% for the operational output signal MV01 has been selected as 800° C.–850° C. based on the knowledge that operation of the fluidized bed in the temperature range is preferable from various points of view, such as better incineration efficiency, prevention of sintering of the fluidized bed, better desulfurization efficiency (in the case of coal burning), prevention of carbon monoxide generation (in the case of coal burning) and so forth.

When the set temperature value signal SV02 in the temperature controller 33 is reduced, then the input signal PV02 from the temperature sensor 3*a* and the set temperature value signal SV02 in the temperature controller 33 do not match, so the temperature controller 33 will be caused to operate to reduce this difference by increasing the operational output signal MV02.

Then, since larger set flow values have been established at the flow controller 34 which receives the increased operational output signal MV02 as the set flow rate value signal SV03, the operational output signal MV03 will be increased so as to match the input signal PV03 from the flow meter 9*b* with the newly established set value. Thus the opening degree of the control valve 9*a* will be increased and the velocity of the heat recovery air which is fed to the air dispersion plate 8 via the heat recovery air pipe 9 and then jets into the heat recovery chamber 4 will be increased.

Consequently as clearly seen from the graph shown in FIG. 4 already explained, the heat transfer coefficient of the moving bed in the heat recovery chamber 4 will also have a tendency to increase in accordance with the tendency of the velocity of the heat recovery air and the amount of thermal energy transferred to the boiler drum 17 from the heat recovery chamber 4 through the heat recovery tube 10 will also be increased.

Increasing the amount of thermal energy in accordance with the velocity of the heat recovery air as above explained may enable the steam pressure to be increased and restored to its previous level for a short period of time in such a manner as to discharge heat accumulated in the moving bed in the heat recovery chamber 4 to the heat recovery tube 10. However, this only occurs momentarily before the steam pressure increases in accordance with the amount of combustibles supplied, which takes a longer time, as already explained.

When the steam pressure has been raised and returns to its previous level, the input signal PV01 to the the pressure controller 31 from the pressure gauge **20*b* will also exhibit a tendency to increase. Since the pressure controller 31 will be balanced at the point where the input signal PV01 has increased to match the predetermined set pressure value signal SV01, the operational output signal MV01 from the pressure controller 31 will become settled at the median point (50%). Correspondingly, the amount of combustibles to be supplied to the combustibles supply means 14 will also be reset to the median (50%) and at this time, in correlation therewith, the air velocity of the heat recovery air at the air dispersion plate in the heat recovery chamber 4** will also be returned close to the median (50%). The operation explained above is exercised as a response of the system to any external disturbance due to a reduction in steam pressure. The operation will of course be reversed in response to any external distrubance due to an increase in steam pressure.

In summary, the incineration control apparatus according to the present invention is applied to a fluidized bed type boiler having an incineration chamber 3 filled with fluidizing medium and adapted to incinerate combustibles and a heat recovery chamber 4 located adjacent to the incineration chamber and defined in such a manner as to enable the fluidizing medium in the incineration chamber to be circulated thereto and capable of recovering the heat in the fluidizing medium in the heat recovery chamber and transferring it to the boiler drum 17 through the heat recovery means 10 and 11 provided in the heat recovery chamber in accordance with the amount of heat recovery air supplied in the heat recovery chamber 4 from the heat recovery air supply means **6*a*, 8, 8*a*, 8*a'* and 8*b* provided in the heat recovery chamber, the incineration control apparatus being so constructed that the control means 31, 32, 33, 34, 9, 9*a* and 9*b* for controlling the amount of heat recovery air supplied in accordance with the steam pressure controls the amount of air (or the air velocity) to be supplied into the heat recovery chamber 4 in accordance with the steam pressure in response to the steam pressure signal PV01 from the pressure gauge 20*b* which serves as the means for detecting the steam pressure. In this manner, the amount of thermal energy transferred to the boiler drum 17 from the heat recovery chamber 4 may be controlled in accordance with the steam pressure. Typically, the amount of combustibles supplied may be controlled in accordance with the steam pressure in such a way that the pressure controller 31 serving as the control means for controlling the amount of combustibles supplied will provide the operational output signal MV01 to the combustibles supply means 14 so that the steam pressure signal PV01 from the pressure gauge 20*b* serving as the steam pressure detecting means may be balanced relative to the set pressure value signal SV01. On the other hand, the temperature controller 33 serving as the heat recovery air supply control means 33, 34, 9, 9*a*, 9*b* will supply the operational output signal MV02 to the flow controller 34 as the set value signal SV03 so that the temperature signal PV02 from the temperature detecting means 3*a* may be balanced relative to the set temperature value signal SV02. The flow controller 34 supplies the operational output signal MV03 to the control value 9*a* so that the (air) flow signal PV03 from the flow meter 9*b* may be balanced relative to the set value signal SV03, varies the amount (air velocity) of air supplied into the heat recovery chamber 4 and controls the amount of thermal energy transferred to the boiler drum 17 from the heat recovery chamber 4 in accordance with the temperature. Two kinds of control operations as above explained may be interrelated by correlating the operational output signal MV01 from the pressure controller 31 with the set value signal SV02 supplied to the temperature controller 33 by the signal inverter 32 as the set temperature control means. In this way, while a control operation serving to execute long term control is executed by the pressure controller 31 acting as the combustibles supply control means to constantly secure the correct amount of combustibles irrespective of increases or decreases in the steam pressure caused by variations in the steam load, the amount (or air velocity) of heat recovery air supplied into the heat recovery chamber 4 may be increased or decreased for a short period of time in accordance with the steam pressure, so that the heat accumulated in the fluidizing medium in the heat recovery chamber 4 may be transferred to the boiler drum 17 in such a manner as to be discharged momentarily, or heat supply to the boiler drum 17** may be restricted in such a manner as to accumulate heat momentarily in the fluidizing medium. Thus the operation of controlling the steam pressure may be rapidly executed whenever there is a variation in the steam load.

It is to be noted, however, that in the incineration control apparatuses shown in FIGS. 5A and 5B, since the amount of combustibles to be supplied is controlled solely on the basis of steam pressure, when it is necessary to constantly control the amount of combustibles supplied in the face of variations in the steam load or steam pressure over a long period of time, it becomes necessary to constantly adjust the amount of combustibles supplied by the combustibles supply means 14 which involves making the control of the steam pressure at the pressure controller 31 out of balance. As a result, with regard to the control of the steam pressure on the basis of the velocity of the heat recovery air through cooperation between the temperature controller 33 and the flow controller 34, it has to be taken into consideration that keeping the air velocity of the heat recovery air near the median (or 50%) in the face of external disturbances will become impossible and that it will be difficult to uniformly achieve maximization of the amount of thermal energy recovered and transferred to the boiler drum 17 which may involve both increases and decreases of such amount.

Figure 7A:
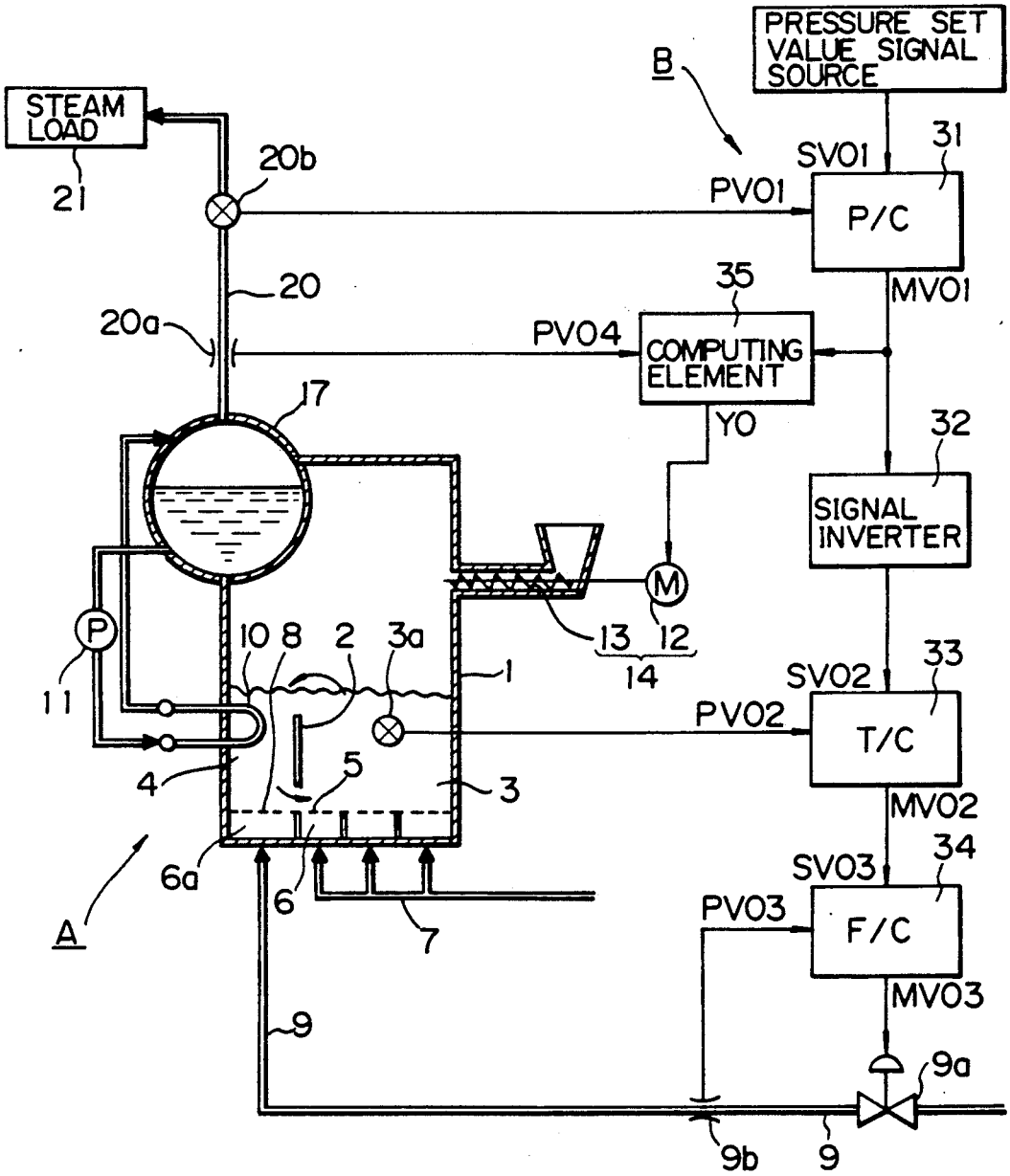
Figure 7B:
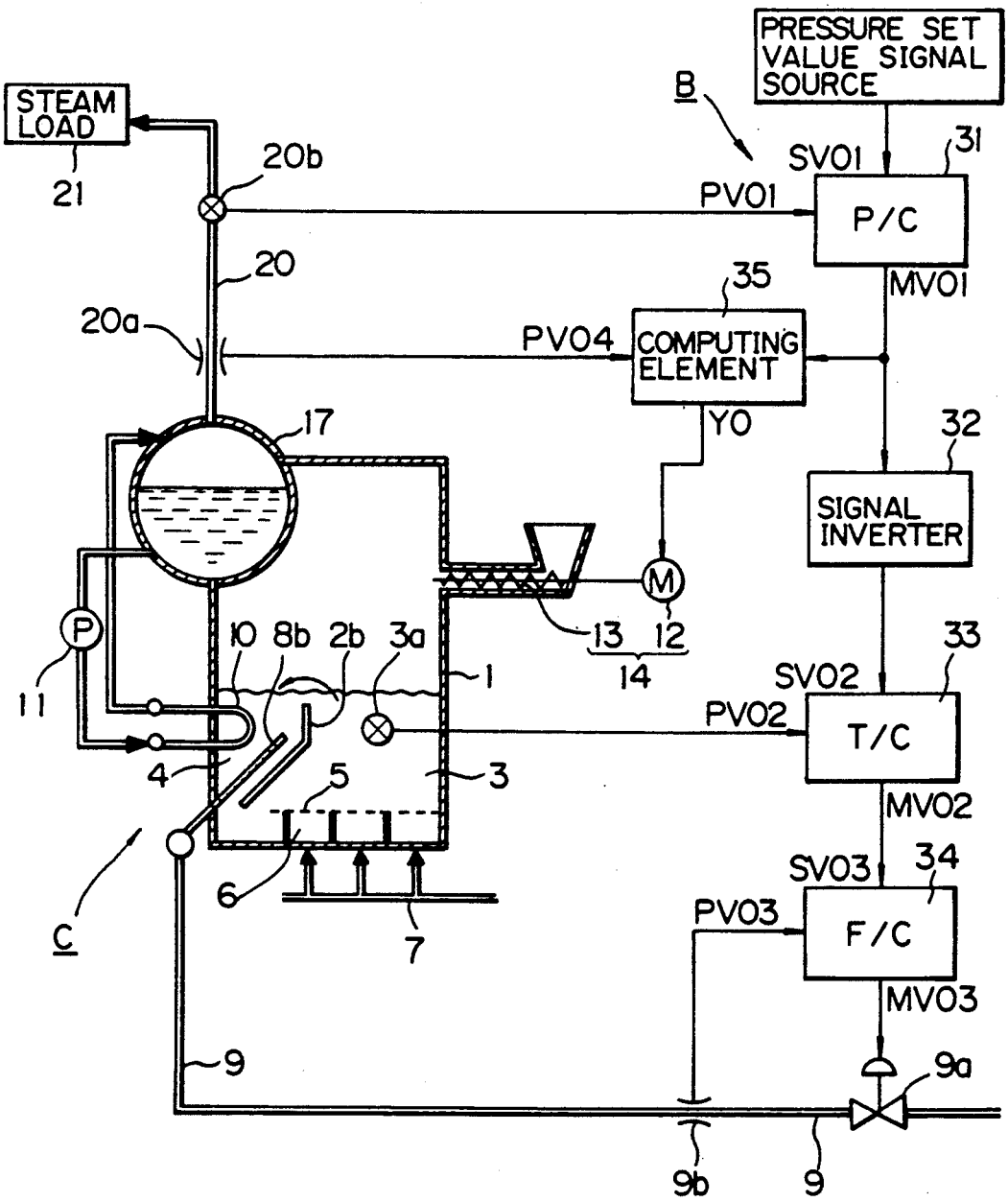

FIGS. 7A and 7B illustrate a second embodiment of an incineration control apparatus according to the present invention which can be applied respectively to the boiler A shown in FIG. 2A and the boiler C shown in FIG. 2B.

In FIG. 7A, an output terminal of a flow meter **20*a* contained in a steam pipe 20 is connected to one of the input terminals of a computing element 35 which serves as a means for controlling the amount of combustibles supplied on the basis of a steam load, while the other input terminal of the computing element 35 is connected to a terminal for the operational output signal MV01 from a pressure controller 31. An output terminal of the computing element 35 is connected to a motor 12 of a combustibles supply means 14. the remaining constitution is identical to that of the first embodiment shown in FIGS. 5A and 5B**.

Operation of the incineration control apparatus shown in FIG. 7A will now be explained. As the steam load is increased, the steam pressure which is detected by the pressure gauge **20*b* will decrease and the operational output signal MV01 from the pressure controller 31 will thus have a tendency to increase. This is the same as the case of the first embodiment (shown in FIGS. 5A and 5B). However, the operational output signal MV01 is not provided directly to the motor 12 of the combustibles supply means 14 like in the first embodiment, but is instead supplied to the other input terminal of the computing element 35**.

During this time, since an output signal from the flow meter **20*a* contained in the steam pipe 20 is supplied as an input signal PV04 indicating that the steam flow rate has a tendency to increase, the computing element 35 will calculate the arithmetic output signal YO expressed in the following equation in accordance with the input signal PV04 and the operational output signal MV01 and supply them to the motor 12**.

$$YO = PV04 + a(2MV01 - 100)$$

wherein "a"=a constant value, thus determining the variation range of the arithmetic output signal YO.

An explanation will now be given regarding how the arithmetic output signal YO is determined by the signal PV04 and MV01 provided by the flow meter **20*a* and the pressure controller 31, referring to FIGS. 8 and 9**.

Figure 8:
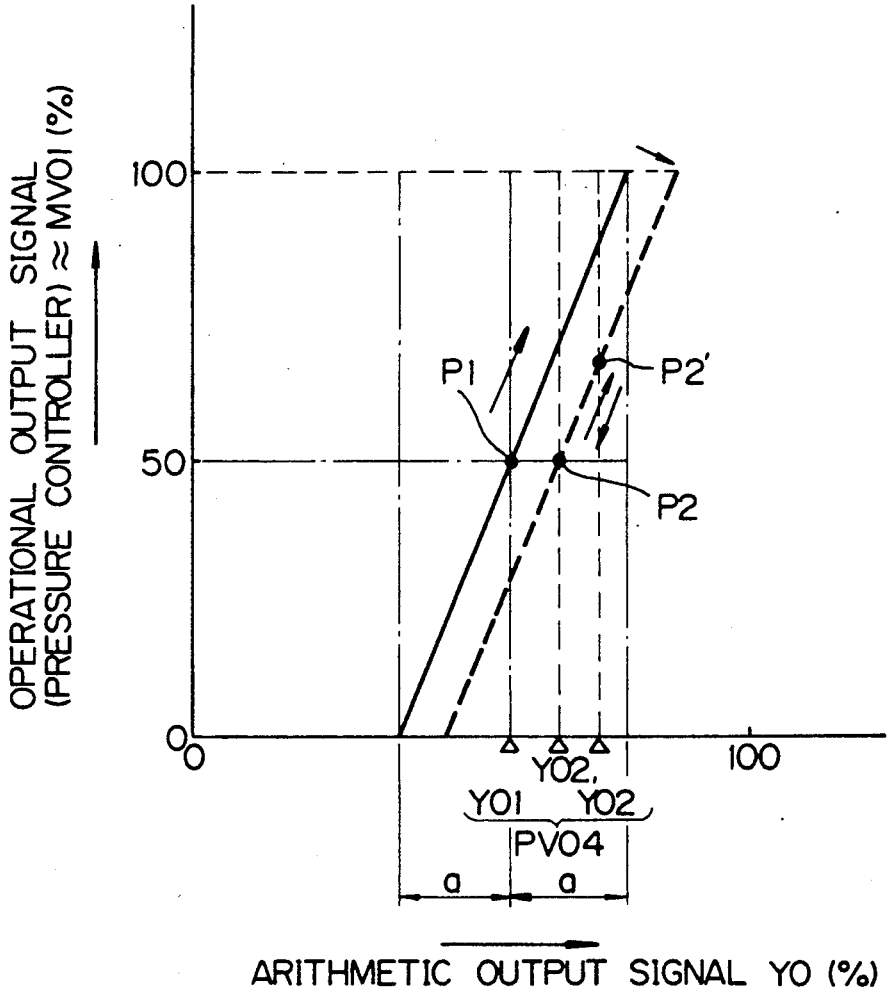

FIG. 8 is a graph showing the relationship between the operational output signal MV01 supplied to the other input terminal of the computing element 35 and the arithmetic output signal YO from the computing element. The operation point P1 which represents a normal condition wherein the operational output signal MV01 from the pressure controller 31 is settled at 50% is located on the characteristic curve shown by the solid line, and the arithmetic output signal YO on the abscissa corresponding to the point P1 may thus be defined. As is clear from the above-mentioned equation, the arithmetic output signal YO is also governed by the input signal PV04 supplied to one of the input terminals of the computing element 35.

Figure 9:
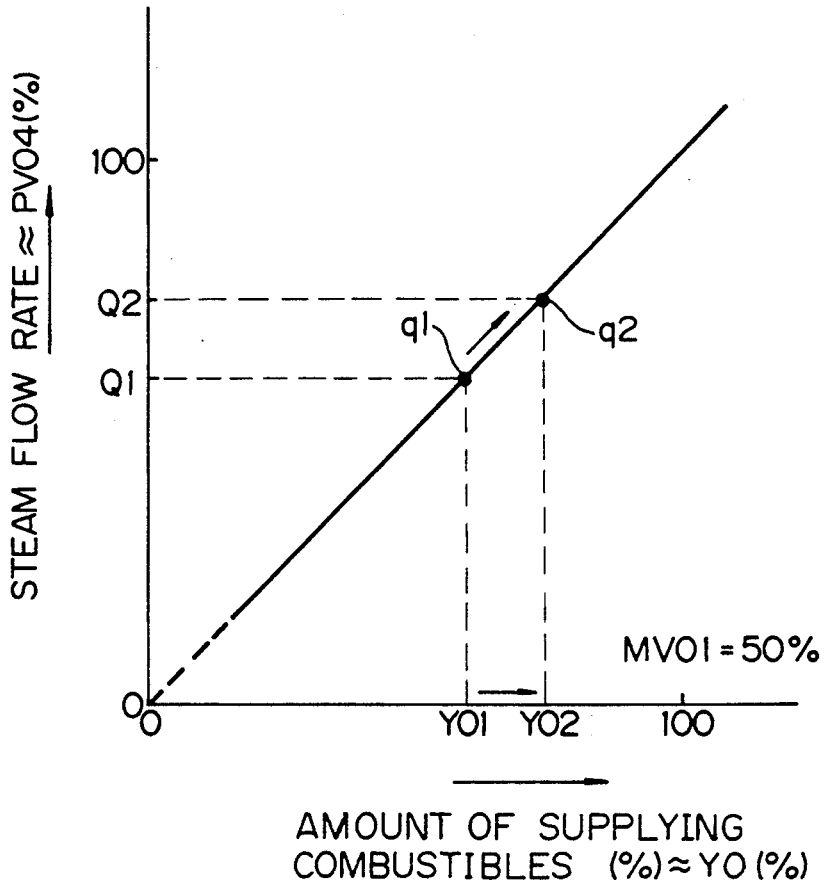

FIG. 9 is a graph showing the relationship between the steam flow rate (PV04) detected by the flow meter **20*a* and the amount of combustibles supplied (%) or the arithmetic output signal YO supplied to the combustibles supply means 14, from the computing element 35. Since this relationship is included in the input and output characteristics of the computing element 35 as being governed by the input signal PV04, if the steam flow rate (PV04) is Q1 at a normal condition, i.e. at 50%, the operation point q1 is located on the characteristic curve and the arithmetic output signal YO1 on the abscissa corresponding to the operation point may be defined. It will be understood that the arithmetic output signal YO1 coincides with the arithmetic output signal YO1 corresponding to the operation point P1 on the characteristic line indicated by the solid line in FIG. 8**.

When the steam load increases and the steam flow rate (PV04) is increased in stepwise fashion from Q1 to Q2, then the operation point is shifted from q1 to q2 on the characteristic line in FIG. 9. Accordingly, since the value of the arithmetic output signal YO increases in stepwise fashion from YO1 to YO2, the characteristic line drawn as a solid line in FIG. 8 will be shifted upwardly and rightwardly in the drawing to the position of the characteristic line drawn as a dotted line and consequently the operation point P1 will be immediately shifted to the operation point P2.

Since the steam pressure will respond to increases in the steam flow rate (PV04) accompanied by an increase in the steam load in an integral manner, the steam pressure will drop temporarily and the input signal PV01 from the pressure gauge **20*b* to the pressure controller 31 will also be reduced. In response to this reduction, the operational output signal MV01 from the pressure controller 31 will be gradually increased and the operation point P2 on the characteristic line drawn as a dotted line in FIG. 8 will also be raised along the characteristic line to the operation point P'2 for example. Accordingly, the arithmetic output signal YO on the abscissa in FIG. 8** will be gradually increased to the point YO2'.

Subsequently, in response to the gradual increase in the arithmetic output signal YO, the speed of the motor 12 will increase and the amount of combustibles supplied by the combustibles supply means 14 will also be increased, whereby incineration in the incineration chamber 3 will become active and an increased amount of evaporation will be generated in the boiler drum 17. This will in turn cause the steam pressure to gradually rise and, in the long run, the operational output signal MV01 from the pressure controller 31 will be forced up to the value of 50% at the time where the pressure controller 31 is in a balanced condition and will settle at that value.

During this operation, the cooperation of the signal inverter 32, which responds concurrently to gradual increases in the arithmetic output signal YO by causing an increase in the operational output signal MV01, with the temperature controller 33 and the flow controller 34 will control the amount of thermal energy transferred to the boiler drum 17 from the heat recovery chamber 4, as already explained, whereby the balancing operation conducted by the pressure controller 31 will be facilitated.

Accordingly the operation point P2' which has once been raised along the characteristic curve drawn as a dotted line in FIG. 8 will be forced downwardly to settle at the operation point P2. The arithmetic output signal YO corresponding to the operation point P2 will at this time settle at the value YO2 to secure the operation point q2 corresponding to the steam flow rate Q2 which is constantly increasing along the characteristic line shown in FIG. 9. Thus, when the amount of combustibles supplied by the combustibles supply means 14 is increased or decreased by the constant changing of the value of the arithmetic output signal YO from the computing element 35 in response to the constant variations in the steam load, the operational output signal MV01 from the pressure controller 31 may be constantly forced down to the value of 50%.

This will enable the variable amount of thermal energy recovered and transferred to the boiler drum 17 from the heat recovery chamber 4 to be maximized uniformly whether increases or decreases in this amount are taking place since the velocity of the heat recovery air is kept constantly at the median point thereof within controllable range with the steam pressure in a normal condition. This is possible because the steam pressure is rapidly restored to the previous level when an increase or decrease occurs, this being achieved by causing an instantaneous increase or reduction in the amount of thermal energy in accordance with the velocity of the heat recovery air through the cooperation of the signal inverter 32, the temperature controller 33 and the flow controller 34, which operate in the same manner as in the first embodiment (illustrated in FIGS. 5A and 5B).

The second embodiment of the incineration control apparatus according to the present invention as applied to the boiler A shown in FIG. 2A has been explained with reference to FIG. 7A. Since application of the control apparatus to the boiler C shown in FIG. 2B is similar to the above application, explanation of the incineration control apparatus shown in FIG. 7B is omitted here.

In summary, according to the second embodiment of the incineration control apparatus according to the present invention, the computing element 35 which serves as the combustibles supply control means for controlling the amount of combustibles supplied on the basis of steam load computes and generates the arithmetic output signal YO required for securing constant adjustment of the amount of combustibles supplied in correspondence with the constant variations in the steam load which depend on the steam flow rate when supplied with the operational output signal MV01 (50%) from the pressure controller 31 which serves as the combustibles supply control means during the time when the system is in a balanced condition, this signal then being output to the combustibles supply means 14. This will cause the pressure controller 31 to be kept constantly balanced in the normal condition regardless of the prevailing steam load or the amount of combustibles supplied, keep the operational output signal MV01 at the value of 50%, bring the amount of heat recovery air supplied (or the air velocity) close to the median of 50% at the heat recovery air supply control means 33, 34, 9, **9*a* and 9*b* which respond to the operational output signal MV01**, and thus uniformly maximize the range of variation in the amount of heat recovery air supplied whether the amount thereof is increasing or decreasing.

According to the second embodiment of the incineration control apparatus of the present invention, if there is a constant amount of the fluidizing medium which flows from the incineration chamber 3 to the heat recovery chamber 4 (the constant amount being determined by the incineration air velocity which is fixedly set), this will cause the heat accumulated in the fluidizing medium contained in the moving bed in the heat recovery chamber to be discharged momentarily so as to be transferred to the boiler drum 17. However, the amount of fluidizing medium which may be diverted from the incineration chamber 3 to the heat recovery chamber 4 is not controlled at all. Accordingly, the amount of thermal energy may be advantageously increased or decreased due to a variation in the velocity of the heat recovery air when there is a balanced condition at each of the heat recovery air supply control means 33, 34, 9, **9*a* and 9*b*. However, since the thermal energy accumulated in the fluidizing medium contained in the moving bed in the heat recovery chamber 3 is not fully controlled, when the steam pressure is restored to the normal condition following an external disturbance which causes an increase in pressure, the amount of thermal energy accumulated in the heat recovery chamber 4** will be so little that there may be difficulty in momentarily restoring the steam pressure.

Figure 10A:
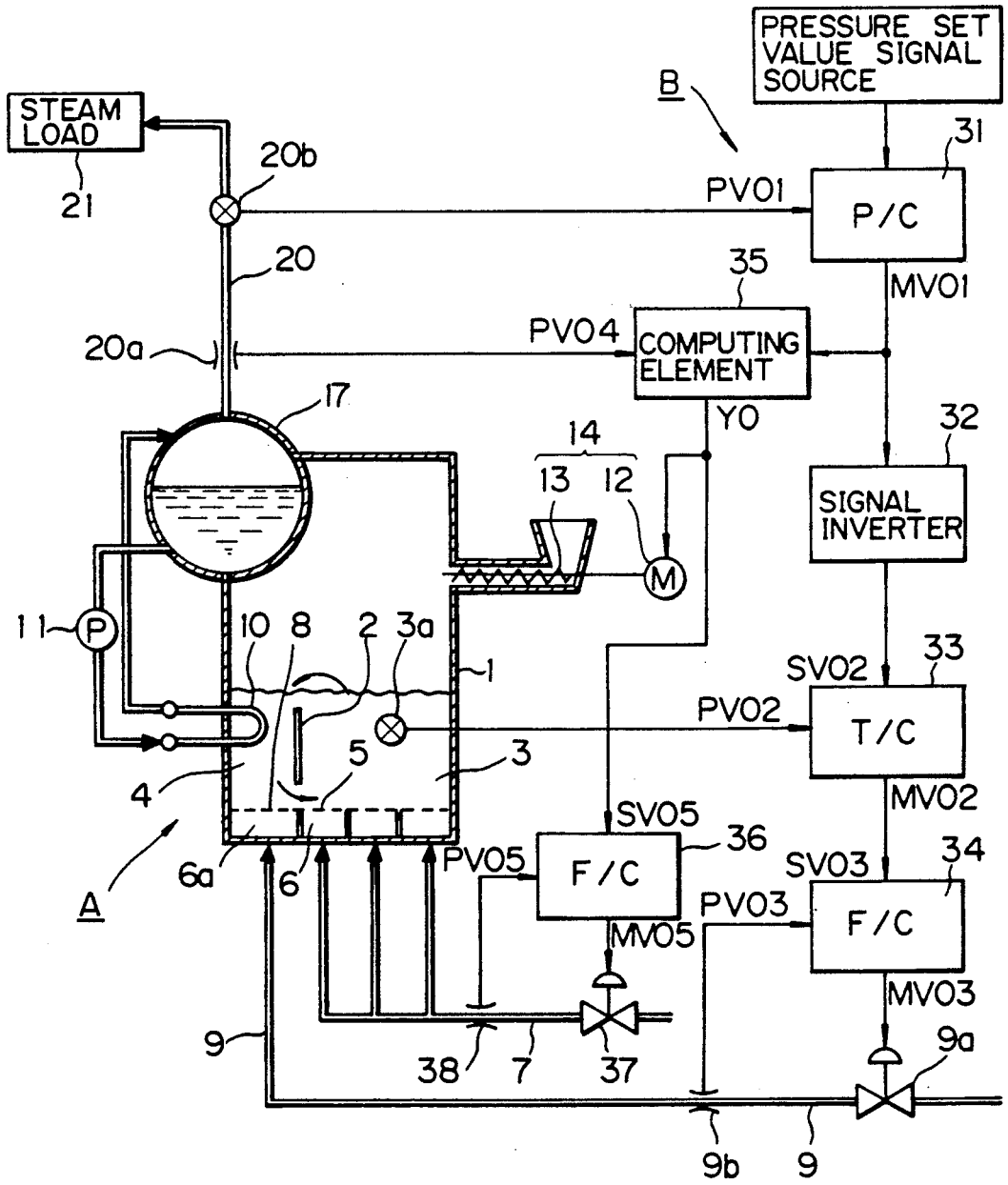
FIGS. 10A and 10B are block diagrams showing a third embodiment of the incineration control apparatus according to the present invention.
Figure 10B:
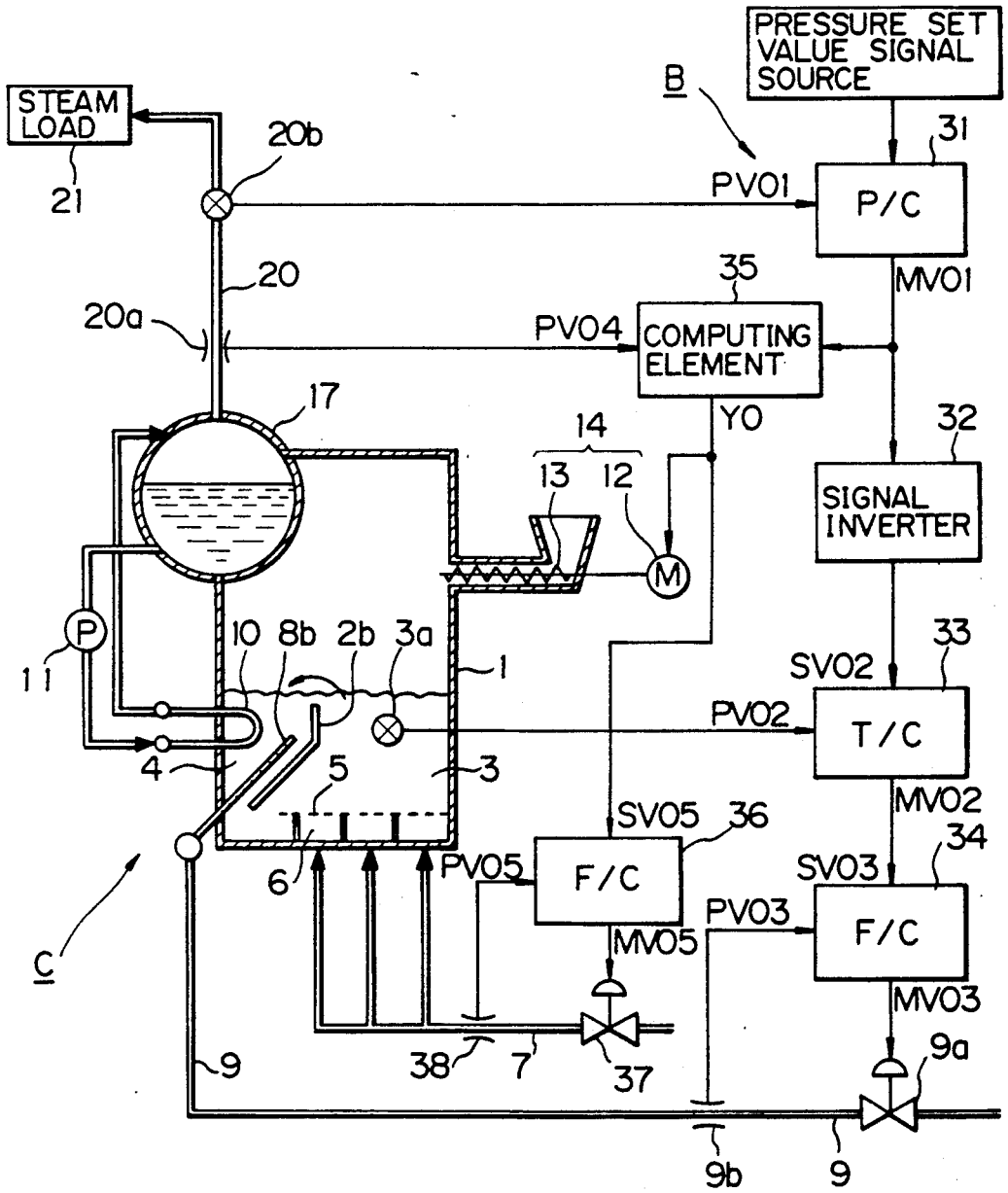

FIGS. 10A and 10B illustrate the constitution of a third embodiment of the incineration control apparatus according to the present invention which is applied to the boiler A shown in FIG. 2A and the boiler C shown in FIG. 2B. The difference between the third embodiment and the second embodiment shown in FIGS. 7A and 7B resides in that the signal line connected from the output terminal of the computing element 35 to the motor 12 incorporated in the combustibles supply means 14 is also branched at a point along it before it reaches the motor, this branch leading to the terminal for the flow set value signal SV05 for the incineration air supply flow controller 36.

In the incineration air supply pipe 7 extending to the air chamber 6 from a incineration air source not shown in the drawing, there are a control valve 37 and a flow meter 38 provided in that order toward an air chamber 6. The terminal for a operation output signal MV05 of a incineration air flow controller 36 is connected to the control terminal of a control valve 37 and the output terminal of the flow meter 38 is connected to the terminal for a input signal PV05 of the flow controller 36. The flow controller 36, the control valve 37 in the incineration air pipe 7 and the flow meter 38 in the air pipe constitute a incineration air supply control means.

According to the constitution as explained above, at the time of momentary increase or decrease of the steam load, as the steam flow rate detected by the flow meter **20*a* increases or decreases, the input signal PV04 to the computing element 35 will be increased or decreased and in response thereto the computing element will shift momentarily the operation point on the characteristic curve shown in FIG. 8 upwardly either leftwardly or rightwardly so as to instantaneously increase or decrease the arithmetic output signal YO from the computing element 35. This will ensure momentary restoration of the steam pressure. On the other hand, if the steam pressure detected by the pressure gauge 20*b* depending on the normal change of the steam load is increased or decreased in a normal manner, the computing element 35 will vary the position of stable operation at the time of balanced condition of the pressure controller 31 depending on the amount of the steam flow and provide to the electric motor 12 normal arithmetic output signal YO corresponding to the increased or decreased steam load. This will ensure a control operation for the steam pressure for a long period of time. Since such output signal YO from the computing element 35 is also supplied to the incineration air supply flow controller 36 as a flow rate set value signal SV05, supposing that the steam load is increased so that the amount of combustibles supplied by the combustibles supply means 14 will show a sign of increase, the flow rate set value signal SV05 which is the output signal from the computing element 35 will also show a sign of increase. Consequently since the input signal PV05 will not coincide with the flow rate set value signal SV05 at the flow controller 36, the flow rate controller 36 will increase the operational output signal MV05 and increase opening degree of the control valve 37**.

As a result, when the steam load is normally increased and the amount of the supplied combustible is also increased normally, then the opening degree of the control valve 37 is also normally increased, so that the velocity of the incineration air which is injected into the incineration chamber 3 from the air chamber 6 through the incineration air pipe 7 will also be increased. According to the operation point on the operational curve as explained with reference to FIG. 3A will be shifted in the direction indicated by the arrow shown in FIG. 3A and the amount of the fluidizing medium which flows from the incineration chamber 3 to the heat recovery chamber 4 will be increased, so that the parameter (or the amount of circulation of the fluidizing medium) in the operation curves illustrated in FIG. 3B as explained already will correspondingly be increased and the operational curves of the operation in question will be moved in the direction indicated by the arrow.

Therefore, the amount of the fluidizing medium flowing from the heat recovery chamber 4 to the incineration chamber 3 or the amount of circulation of the fluidizing medium will be increased and such fluidizing medium will be carried to the fluidizing medium contained in the moving bed in the heat recovery chamber 4, causing the thermal energy accumulated in the moving bed to be increased and restricting reduction of the temperature of the moving bed varying depending on the recovery thermal energy to keep the temperature at a high level.

Since the heating value R recovered into the boiler drum 17 from the heat recovery chamber 4 is expressed by the equation:

$$R = A * \alpha * \Delta T$$

where

A = the effective heat receiving area of the heat recovery tube 10

$\alpha$ = coefficient of heat transfer $\Delta T$ = difference in temperature between the fluidizing medium in the moving bed in the heat recovery chamber 4 and the steam in the boiler drum 17, maintenance at a high level of the temperature of the fluidizing medium in the moving bed in the heat recovery chamber 4 means that more thermal energy may be recovered. Thus even if the steam load is usually excessive sufficient recovery of the thermal energy into the boiler drum from the heat recovery chamber 4 may ensure a quick restoration of the steam pressure.

As clearly seen from the foregoing explanation, in the third embodiment of the incineration control apparatus according to the present invention, the incineration air supply control means 7, 36, 37 and 38 will respond to the continuously increasing arithmetic output signal YO supplied from the computing element 35 included in the means for controlling the amount of combustible supplied depending on the steam load when the steam load is increasing in a normal manner, increase the amount of the incineration air supply (or the velocity of air for incineration) into the incineration chamber 3, increase the amount of the fluidizing medium circulating in the heat recovery chamber 4 and increase the thermal energy carried from the incineration chamber 3 and stored in the fluidizing medium. This will ensure sufficient amount of the thermal energy recovered into the boiler drum 17 from the heat recovery chamber 4 even if the steam load is normally excessive, whereby upward restoration of the steam pressure due to insufficient thermal energy recovered may be prevented from being delayed.

POSSIBILITY OF INDUSTRIAL UTILIZATION

According to the present invention, since the steam pressure in the boiler drum is correlated to control of the thermal energy recovered into the boiler drum, so that response of control of the steam pressure against variation caused by variation of the steam load is enhanced, the present invention may be applied to the control means in a fluidized bed type boiler adapted to incinerate such combustible as municipal refuse, industrial waste, coal or the like.

We claim:

1. An incineration control apparatus for a fluidized bed type boiler comprising:

an incineration chamber (3) filled with fluidizing medium for incinerating combustibles in said fluidizing medium;

combustibles supply means (14) for supplying a specified amount of combustibles to said incineration chamber (3);

incineration air supply means (5, 5*a*, 6, 7) for supplying incineration air to said incineration chamber (3);

a boiler drum (17) for receiving heat from said incineration chamber (3);

a heat recovery chamber (4) adjacent to said incineration chamber (3) and so defined that said fluidizing medium in said incineration chamber (3) may be circulated therethrough;

heat recovery air supply means (6*a*, 8, 8*a*, 8*a*', 8*b*) for supplying heat recovery air to said heat recovery chamber (4) at a specified air velocity (or mass velocity);

heat recovery means (10, 11) provided in said heat recovery chamber (4) for recovering and transferring to said boiler drum (17) the heat in said fluidizing medium circulating through said heat recovery chamber (4) in accordance with the specified velocity (or mass velocity) of the heat recovery air;

steam pressure detecting means (20*b*) for detecting the steam pressure in said boiler drum (17) and for outputting a steam pressure signal (PV01) indicating said steam pressure; and steam pressure dependent heat recovery air supply control means (31, 32, 33, 34, 9, 9*a*, 9*b*) adapted to respond to said steam pressure signal (PV01) and to control the velocity (mass velocity) of the heat recovery air at said heat recovery air supply means (6*a*, 8, 8*a*, 8*a*', 8*b*) on the basis of steam pressure.

2. An incineration control apparatus as claimed in claim 1, wherein said steam pressure detecting means comprises a pressure gauge disposed in a steam pipe (20) connecting said boiler drum (17) to a steam pressure load (21).

3. An incineration control apparatus as claimed in claim 2, wherein said steam pressure dependent heat recovery air supply control means supplies to said combustibles supply means (14) an operational output signal (MV01) for controlling the supply amount of combustibles in response to the steam pressure signal (PV01) output from said pressure gauge.

4. An incineration control apparatus as claimed in claim 3 further including a temperature sensor (3*a*) for detecting the temperature in said incineration chamber (3) and for outputting a temperature signal (PV02) indicating said temperature, wherein said steam pressure dependent heat recovery air supply control means includes heat recovery air supply control means (33, 34, 9a, 9b) which respond to said steam pressure signal (PV01) and said temperature signal (PV02) and control the velocity (or mass velocity) of heat recovery air at said heat recovery air supply means (6a, 8, 8a, 8a', 8b) such as to cause the temperature in said incineration chamber (3) to coincide with a specified temperature set value.

5. An incineration control apparatus as claimed in any one of claims 1 to 4, wherein said fluidizing medium circulating through said heat recovery chamber (4) forms a moving bed which moves from upward to downward in said chamber.

6. An incineration control apparatus for a fluidized bed type boiler comprising:

an incineration chamber (3) filled with fluidizing medium for incinerating combustibles in said fluidizing medium;

combustibles supply means (14) for supplying a specified amount of combustibles to said incineration chamber (3);

incineration air supply means (5, 5a, 6, 7) for supplying incineration air to said incineration chamber (3);

a boiler drum (17) for receiving heat from said incineration chamber (3);

a heat recovery chamber (4) adjacent to said incineration chamber (3) and so defined that said fluidizing medium in said incineration chamber (3) may be circulated therethrough;

heat recovery air supply means (6a, 8, 8a, 8a', 8b) for supplying heat recovery air to said heat recovery chamber (4) at a specified air velocity (or mass velocity);

heat recovery means (10, 11) provided in said heat recovery chamber (4) for recovering and transferring the heat in said fluidizing medium circulating through said heat recovery chamber (4) to said boiler drum (17) in accordance with the specified velocity (or mass velocity) of the heat recovery air;

steam pressure detecting means (20b) for detecting the steam pressure in said boiler drum (17) and for outputting a steam pressure signal (PV01) indicating said steam pressure;

combustibles supply control means (31) for controlling the amount of combustibles supplied by combustibles supply means (14) in response to said steam pressure signal (PV01);

temperature detecting means (3a) for detecting the temperature in said incineration chamber (3) and for outputting a temperature signal (PV02) indicating said temperature;

heat recovery air supply control means (33, 34, 9, 9a, 9b) for controlling the velocity (or mass velocity) of heat recovery air at said heat recovery air supply means (6a, 8, 8a, 8a', 8b) in response to said temperature signal (PV02) such as to cause temperature indicated by said temperature signal to coincide with a specified temperature set value; and temperature set value control means (32) for controlling a temperature set value at the heat recovery air supply control means (33, 34, 9, 9a, 9b) in unison with control of the amount of combustibles supplied by said combustibles supply means (14) which is controlled by said combustibles supply control means (31).

7. An incineration control apparatus as claimed in claim 6, wherein said steam pressure detecting means comprises a pressure gauge (20b) disposed in a steam pipe (20) connecting said boiler drum (17) to a steam pressure load, and said temperature detecting means comprises a temperature sensor (3a) disposed in said incineration chamber (3).

8. An incineration control apparatus as claimed in claim 7, wherein said specified temperature set value is a temperature set value (SV02) corresponding to the output from said combustibles supply control means (31), and said heat recovery air supply control means comprises a temperature controller (33) adapted to receive said specified temperature set value signal (SV02) and the temperature signal (PV02) from said temperature sensor (3a) and output a flow rate set value signal (MV02) indicating the flow rate set value, and comprises a flow rate controller (34) adapted to receive said flow rate set value signal (MV02) and control the flow rate of the heat recovery air by regulating the opening rate of a control valve (9a) provided in an air pipe (9) such as to cause said velocity of heat recovery air to coincide with said flow rate set value signal (MV02).

9. An incineration control apparatus as claimed in claim 6, wherein said temperature set value control means comprises as inverter (32) adapted to invert the output from said combustibles supply control means (31).

10. An incineration control apparatus for a fluidized bed type boiler comprising:

an incineration chamber (3) filled with fluidizing medium for incinerating combustibles in said fluidizing medium;

combustibles supply means (14) for supplying a specified amount of combustibles to said incineration chamber (3);

incineration air supply means (5, 5a, 6, 7) for supplying incineration air to said incineration chamber (3);

a boiler drum (17) for receiving heat from said incineration chamber (3);

a heat recovery chamber (4) adjacent to said incineration chamber (3) and so defined that said fluidizing medium in said incineration chamber (3) may be circulated therethrough;

heat recovery air supply means (6a, 8, 8a, 8a', 8b) for supplying heat recovery air to said heat recovery chamber (4) at a specified air velocity (or mass velocity);

heat recovery means (10, 11) disposed in said heat recovery chamber (4) for recovering and transferring the heat in said fluidizing medium circulating through said heat recovery chamber (4) to said boiler drum (17) in accordance with the specified velocity (or mass velocity) of the heat recovery air;

steam pressure detecting means (20b) for detecting the steam pressure in said boiler drum (17) and for outputting a steam pressure signal (PV01) indicating said steam pressure;

combustibles supply control means (31) for controlling the amount of combustibles supplied by said combustibles supply means (14) in response to said steam pressure signal (PV01);

temperature detecting means (3a) for detecting the temperature in said incineration chamber (3) and for outputting a temperature signal (PV02) indicating said temperature;

heat recovery air supply control means (33, 34, 9, 9a, 9b) for controlling the velocity (or mass velocity) of heat recovery air at said heat recovery air supply means (6a, 8, 8a, 8a', 8b) in response to said temperature signal (PV02) such as to cause temperature indicated by said temperature signal to coincide with a specified temperature set value;

temperature set value control means (32) for controlling a temperature set value at said heat recovery air supply control means (33, 34, 9, 9a, 9b) in unison with control of the amount of combustibles supplied by said combustibles supply means (14) which is controlled by said combustibles supply control means (31);

steam flow rate detecting means (20a) for detecting flow rate of the steam from said boiler drum (17) to a steam load and for outputting a steam flow rate signal (PV04) indicating said flow rate; and steam load dependent combustibles supply control means (35) for controlling the amount of combustibles supplied by the combustibles supply means (14) depending on the flow rate of steam indicated by said steam flow rate signal (PV04) depending on the steam load in addition to control by said combustible supply control means (31) for controlling the amount of combustibles supplied by said combustibles supply means (14).

11. An incineration control apparatus as claimed in claim 10, wherein said steam pressure detecting means comprises a pressure gauge (20b) disposed in a steam pipe (20) connecting said boiler drum (17) to said steam load and said temperature detecting means comprises a temperature sensor (3a) disposed in said incineration chamber (3).

12. An incineration control apparatus as claimed in claim 11, wherein said specified temperature set value is a temperature set value (SV02) corresponding to the output from said combustibles supply control means (31), and said heat recovery air supply control means comprises a temperature controller (33) adapted to receive said specified temperature set value signal (SV02) and temperature signal (PV02) from said temperature sensor (3a) and output a flow rate set value signal (MV02) indicating the flow rate set value, and comprises a flow rate controller (34) adapted to receive said flow rate set value signal (MV02) and control the flow rate of the heat recovery air by regulating the opening rate of a control valve (9a) disposed in an air tube (9) such as to cause said velocity of heat recovery air to coincide with said flow rate set value signal (MV02).

13. An incineration control apparatus as claimed in claim 10, wherein said temperature set value control means comprises a inverter (32) adapted to invert the output from said combustibles supply control means (31).

14. An incineration control apparatus as claimed in claim 10, wherein said steam load dependent combustibles supply control means is a computing element (35) adapted to receive an operational output signal (MV01) output from said combustibles supply control means (31) in response to said steam pressure signal (PV01) and said steam flow rate signal (PV04), and compute an output signal (YO) applied to said combustibles supply means (14) in accordance with the formula of:

$$YO = PV\,04 + a(2MV01 - 100)$$

where

"a" is a coefficient of stipulating the variation range of YO.

15. An incineration control apparatus for a fluidized bed type boiler comprising:

an incineration chamber (3) filled with fluidizing medium for incinerating combustibles in said fluidizing medium;

combustibles supply means (14) for supplying a specified amount of combustibles to said incineration chamber (3);

incineration air supply means (5, 5a, 6, 7) for supplying incineration air at a specified air velocity (or mass velocity) to said incineration chamber (3);

a boiler drum (17) for receiving heat from said incineration chamber (3);

a heat recovery chamber (4) adjacent to said incineration chamber (3) and so defined that said fluidizing medium in said incineration chamber (3) may be circulated therethrough;

heat recovery air supply means (6a, 8, 8a, 8a', 8b) for supplying heat recovery air to said heat recovery chamber (4) at a specified air velocity (or mass velocity);

heat recovery means (10, 11) provided in said heat recovery chamber (4) for recovering and transferring the heat in said fluidizing medium circulating through said heat recovery chamber (4) to said boiler drum (17) in accordance with the specified velocity (or mass velocity) of the heat recovery air;

steam pressure detecting means (20b) for detecting the steam pressure in said boiler drum (17) and for outputting a steam pressure signal (PV01) indicating said steam pressure;

combustibles supply control means (31) for controlling the amount of combustibles supplied by said combustibles supply means (14) in response to said steam pressure signal (PV01);

temperature detecting means (3a) for detecting the temperature in said incineration chamber (3) and for outputting a temperature signal (PV02) indicating said temperature;

heat recovery air supply control means (33, 34, 9, 9a, 9b) for controlling the air velocity (or mass velocity) for heat recovery at said heat recovery air supply means (6a, 8, 8a, 8a', 8b) in response to said temperature signal (PV02) such as to cause the temperature indicated by said temperature signal to coincide with a specified temperature set value;

temperature set value control means (32) for controlling a temperature set value at the heat recovery air supply control means (33, 34, 9, 9a, 9b) in unison with control of the amount of combustibles supplied by said combustibles supply means (14) which is controlled by said combustibles supply control means (31);

steam flow rate detecting means (20a) for detecting flow rate of the steam supplied from said boiler drum (17) to a steam load and for outputting a steam flow rate signal (PV04) indicating said flow rate;

steam load dependent combustibles supply control means (35) for controlling the amount of combustibles supplied by said combustibles supply means (14) in accordance with the flow rate of steam indicated by said steam flow rate signal (PV04) in accordance with the steam load in addition to control by said combustibles supply control means (31) which controls the amount of said combustibles supplied by said combustibles supply means (14); and incineration air supply control means (7, 36, 37, 38) for controlling the velocity (or mass velocity) of incineration air at said incineration air supply means (5, 5*a*, 6, 7), in unison with control of the amount of combustibles supplied by said combustibles supply means (14) under the control by said combustibles supply control means (31) and said steam load dependent combustibles supply control means (35).

16. An incineration control apparatus as claimed in claim 15, wherein said steam pressure detecting means comprises a pressure gauge (20*b*) disposed in a steam pipe (20) connecting said boiler drum (17) to the steam load and said temperature detecting means includes a temperature sensor (3*a*) disposed in said incineration chamber (3).

17. An incineration control apparatus as claimed in claim 16, wherein said specified temperature set value is a temperature set value (SV02) corresponding to the output from said combustibles supply control means (31), and said heat recovery air supply control means comprises a temperature controller (33) adapted to receive said specified temperature set value (SV02) and temperature signal (PV02) from said temperature sensor (3*a*) and output a flow rate set value signal (MV02) indicating the flow rate set value, and comprises a flow rate controller (34) adapted to receive said flow rate set value signal (MV02) and control the flow rate of the heat recovery air by regulating the opening rate of a control valve (9*a*) provided in an air pipe (9) such as to cause said velocity of the heat recovery air to coincide with said flow rate set value signal (MV02).

18. An incineration control apparatus as claimed in claim 15, wherein said temperature set values control means comprises an inverter (32) adapted to invert the output from said combustibles supply control means (31).

19. An incineration control apparatus as claimed in claim 15, wherein said combustibles supply depend on steam load control means is a computing element (35) adapted to receive the operational output signal (MV01) output from said combustibles supply control means (31) in response to said steam pressure signal (PV01), and said steam flow rate signal (PV04) and compute a operational output signal (YO) applied to said combustibles supply means (14) in accordance with the formula of:

$$YO = PV04 + a(2MOV1 - 100)$$

where

"a" is a coefficient of stipulating the variation range of YO.

20. An incineration control apparatus as claimed in claim 19, wherein said incineration air supply control means comprises a control valve (37) adapted to control the flow rate of the incineration air supplied to said incineration chamber (3), a flow meter (38) adapted to detect the flow rate of said incineration air and output the flow rate signal indicating the flow rate and a flow rate controller (36) adapted to receive said operational output signal (YO) and said flow rate signal and regulate the opening rate of said control valve (37) so that said flow rate signal may coincide with said operational output signal.

21. An incineration control apparatus as claimed in any one of claims 1–4, or 6–20, where said incineration air supply means (5, 5*a*, 6, 7) is adapted to supply the incineration air to said incineration chamber (3) at as air velocity more than 2 Gmf and said air supply heat recovery means (6, 8, 8*a*, 8*a*′, 8*b*) is adapted to supply the heat recovery air to said heat recovery chamber (4) at a specified air velocity (or mass velocity) which is in a range from 0 Gmf to 2 Gmf.

22. An incineration control apparatus as claimed in claim 5, wherein said incineration air supply means (5, 5*a*, 6, 7) is adapted to supply the incineration air to said incineration chamber (3) at an air velocity more than 2 Gmf and said air supply heat recovery means (6, 8, 8*a*, 8*a*′, 8*b*) is adapted to supply the heat recovery air to said heat recovery chamber (4) at a specified air velocity (or mass velocity) which is in a range from 0 Gmf to 2 Gmf.

* * * * *